US007222504B2

(12) United States Patent
Nakayama

(10) Patent No.: US 7,222,504 B2
(45) Date of Patent: May 29, 2007

(54) METHOD FOR JOINING KNITTED FABRICS

(75) Inventor: Tomoaki Nakayama, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/553,762

(22) PCT Filed: Mar. 24, 2004

(86) PCT No.: PCT/JP2004/004097

§ 371 (c)(1),
(2), (4) Date: Oct. 20, 2005

(87) PCT Pub. No.: WO2004/094711

PCT Pub. Date: Nov. 4, 2004

(65) Prior Publication Data

US 2006/0236725 A1 Oct. 26, 2006

(30) Foreign Application Priority Data

Apr. 21, 2003 (JP) ..... 2003-116375

(51) Int. Cl.
*D04B 7/04* (2006.01)

(52) U.S. Cl. ..... 66/64; 66/176

(58) Field of Classification Search ..... 66/64, 66/170–176

See application file for complete search history.

(56) References Cited

U.S. PATENT DOCUMENTS 3,695,063 A * 10/1972 Betts et al. ..... 66/176
4,197,724 A * 4/1980 Robinson et al. ..... 66/176
5,826,445 A * 10/1998 Okamoto ..... 66/70
5,987,930 A * 11/1999 Nakai ..... 66/69
6,286,340 B1 * 9/2001 Yui ..... 66/70
6,658,900 B2 12/2003 Okamoto
6,988,384 B2 * 1/2006 Okamoto ..... 66/64

FOREIGN PATENT DOCUMENTS

WO WO 01/88243 A1 11/2001

* cited by examiner

*Primary Examiner*—Danny Worrell
(74) *Attorney, Agent, or Firm*—Rothwell, Figg, Ernst & Manbeck

(57) ABSTRACT

A knitted fabric joining method is provided wherein at least two tubular knitted fabrics are knitted and then those tubular knitted fabrics are overlapped with and joined to each other in such a manner that a joining region of a front knitted fabric part is different in number of wales from a joining region of a back knitted fabric part. Before the start of joining, in the joining region of the front knitted fabric part and the joining region of the back knitted fabric part which are arranged on the opposed needle beds, loops in the joining region of a large gore and loops in the joining region of a small gore are situated in the joining regions containing needles in equal number, respectively, and the loops in the joining region of the one gore are held on an every two or three needle basis and the loops in the joining region of the other gore are held on an every needle basis so that both ends of the one joining region and both ends of the other joining region can substantially correspond in position to each other. Thereafter, the loops of the tubular knitted fabrics are subjected to the bind-off process, while being overlapped with each other, thereby forming a gore at the joining portion of the tubular knitted fabrics.

3 Claims, 19 Drawing Sheets

Fig. 19

Explanations of Letters or Numerals

1...sweater
3a,3b...gore
4...right sleeve
5...left sleeve
6...body
7...hem
8...right cuff
9...left cuff
10...neckline opening
11a,11b...shoulder part
21...first knitted fabric
22...second knitted fabric
31...first knitted fabric
32...second knitted fabric
33...third knitted fabric
41...pants
42...right foot portion
43...left foot portion
45a,45b...gore

METHOD FOR JOINING KNITTED FABRICS

CROSS REFERENCE TO RELATED APPLICATION

This application is a 35 USC § 371 National Phase Entry Application from PCT/JP2004/004097, filed Mar. 24, 2004, and designating the United States.

TECHNICAL FIELD

The present invention relates to a method for joining knitted fabrics in such a manner as to form gores at joining portions of a tubular knitted fabric.

BACKGROUND ART

The knitwear has portions called "gores" formed at joining portions of the parts thereof, such as, for example, at sides of the knitwear and crotch portions of the same. The gores formed at those joining portions serve to add a depth to the knitwear comprising the planar knitted fabric parts, to thereby produce a comfortable wear to suit one's figure.

The applicant of this application already developed and presented a method for joining knitted fabrics of a tubular knitted fabric, according to which one knitted fabric of the tubular knitted fabric to be joined to the other knitted fabric to form the gores therebetween can be allowed to rotate with respect to the other knitted fabric in a direction in which a space between the both knitted fabrics is spread at a larger angle than an angle at which the one knitted fabric is perpendicular to the other knitted fabric (International Publication No. 01/88243).

In this joining method, gore portions of the same courses are previously formed in the both tubular knitted fabrics to be jointed together; then are overlapped with each other in such a manner that the loops located adjacent to each other with respect to the boundary between the front knitted fabric part and the back knitted fabric part are overlapped with each other and the loops located far away from each other with respect to the boundary are overlapped with each other; and then are subjected to the bind-off process, thereby forming the gore portions at the joining portions of the tubular knitted fabric.

This method for joining together the knitted fabrics having the gores can provide the knitwear that can allow a high freedom of body movement.

In this connection, it is desirable from the viewpoint of the body movement that when knitwear, such as, for example, a sweater, is knitted by the joining method mentioned above, the gore portions of the front knitted fabric part should be made larger than those of the back knitted fabric part to produce knitwear of further comfortable to wear.

Making the gore portions of the front knitted fabric part larger than those of the back knitted fabric part requires that the number of wales formed in the joining regions of the front body to front sleeves should be increased over the number of wales formed in the joining regions of the back body to back sleeves.

However, when the knitted fabrics are joined together in such a manner that the number of wales in the front and back joining regions are differentiated from each other, the knitted fabric part having smaller gore portions (the back body) is put in the state in which a part of the loops located at the far side from the body on the needle bed are shifted to the opposite needle bed (front needle bed) at the completion of the joining.

In other words, when the gores different in number of wales from each other are formed in the front and back joining regions in this manner, the front knitted fabric part having the larger gores decreases in knitting width below the back knitted fabric part. In order to lessen this difference in knitting width between the knitted fabrics retained on the front and back needle beds, rotation of the knitting is performed, whereby a loop of the back knitted fabric part located at its lateral end and retained on the needle bed is forced to shift to the outside of a loop of the knitted fabric part located at its lateral end and retained on the opposite needle bed.

When the rotation of the knitting is performed in this manner, the joining is completed in the state in which the loop held on the needle located at the position farthest from the knitted fabric part of the body on the back needle bed remains shifted to the front needle bed before formation of the gores. When the knitting to form the bodies and their respective sleeves into a single tubular starts in this state, a new loop is formed on the old loop originally situated in the back needle bed in the state in which the old loop remains shifted to the front needle bed.

It is to be noted here that when the loop situated in the back needle bed is shifted to the front needle bed, a twist is formed in that loop when shifted to the front needle bed. When a new loop is formed on that old loop, the old loop remains twisted undesirably. Particularly, such a twisted loop appears in sight in the sleeves.

In order to prevent the twist in that loop, the knitted fabrics of the sleeves are subjected to rotation of the knitting before joined to the body so that when the formation of the gores is ended, the loops of the back knitted fabric parts of the sleeves located at lateral ends thereof far from the back knitted fabric part of the body can be placed in the back needle bed and the loops of the front knitted fabric parts of the sleeves located at lateral ends thereof far from the front knitted fabric part of the body can be returned to the front needle bed, as shown in FIG. 18.

FIG. 18(*a*) shows the state of the knitwear at the end of the knitting up to its sides. The parts (311*a*, 311*b*, 312*a*, 312*b*, 321*a*, 321*b*, 331*a*, 331*b*) indicated by dotted lines are the joining regions of the front and back knitted fabric parts. FIG. 18(*b*) shows the state of the knitwear in which the sleeves are subjected to rotation of the knitting for forming the gores.

However, when the knitted fabrics are subjected to the rotation of the knitted in advance of the forming of the gores, the joining regions are put into the state shown in FIG. 18(*b*). Take the joining of the front knitted fabric part of the left sleeve 33 for instance, the joining region of the left sleeve 33 to be joined to the joining region 312*a* of the front body 31*a* is divided into the joining region 331*b* of the back knitted fabric part and the joining region 331*a* of the front knitted fabric part, as viewed in FIG. 18*a*.

When the knitted fabrics are joined together in this state, the boundaries between the front and back knitted fabric parts of the right and left sleeves 32, 33 are displaced forwardly with respect to the boundaries between the front and back knitted fabric parts of the body 31.

It is an object of the present invention to provide a knitted fabric knitting method that can prevent loops of the front and back knitted fabric parts located at ends thereof adjacent to the boundaries therebetween from being shifted to the opposite needle beds before the start of joining of gores, to knit the knitted fabrics having the gores which are easy to knit and easy to move.

DISCLOSURE OF THE INVENTION

To accomplish the object mentioned above, the present invention provides a novel knitted fabric joining method wherein at least two tubular knitted fabrics, each comprising a front knitted fabric part and a back knitted fabric part, are knitted in succession in a direction of course and overlapped with each other at their joining region at which gores of different in size between the front knitted fabric part and the back knitted fabric part are formed, thereby being joined together, using a flat knitting machine comprising at least a pair of front and back needle beds, which extend in a longitudinal direction and are located in opposed positions in a cross direction and at least either of which is capable of being racked in the longitudinal direction.

First, in the knitted fabric joining step, in a joining region of the front knitted fabric part and a joining region of the back knitted fabric part which are arranged on the opposed needle beds, loops in the joining region of a small gore and loops in the joining region of a large gore are situated in the joining regions containing needles in equal number, respectively, and the loops in the joining region of the one gore are held on an every two or three needle basis and the loops in the joining region of the other gore are held on an every needle basis so that both ends of the one joining region and both ends of the other joining region can substantially correspond in position to each other.

Then, loops in a final course of the one tubular knitted fabric which are situated in the joining region and located at a lateral end thereof and loops in a final course of the other tubular knitted fabric which are situated in the joining region and located at a lateral end thereof, the loops of the tubular knitted fabrics being to be joined to each other, are overlapped with each other in such a manner that the loops located adjacent to each other with respect to a boundary between the front knitted fabric part and the back knitted fabric part are overlapped with each other and the loops located far away from each other with respect to the boundary are overlapped with each other and then are subjected to the bind-off process, thereby forming a gore at a joining portion of the tubular knitted fabric and, subsequent to the joining of the tubular knitted fabrics, knitting a single tubular knitted fabric.

In the case of joining the first knitted fabric and the second knitted fabric, the following steps should preferably be taken before the start of joining of the knitted fabrics:

(1) the first step that the loops in the joining region of one of the front knitted fabric part and the back knitted fabric part of the first knitted fabric are transferred to the opposed needle bed, (2) the second step that the second knitted fabric is subjected to rotation of the knitting while either the front needle bed or the back needle bed being racked in either rightward or leftward, and the loops in the joining region as transferred in the first step are sequentially transferred back to the opposed needle bed starting from the loop located at the end far from the second knitted fabric while the first knitted fabric being subjected to the rotation of the knitting for the loops of the first knitted fabric located at end portions thereof far from the second knitted fabric to be transferred to the opposed needle bed, those operations being repeated so that the loops can be arranged on an every two or three needle or an every needle basis in the joining region of the first knitted fabric, (3) the third step that the loops in the joining region of the other knitted fabric part, which corresponds in size to the joining rejoin of one of the front knitted fabric part or the back knitted fabric part of the second knitted fabric from which the loops were transferred in the first step, are transferred to the opposed needle bed, and (4) the fourth step that the first knitted fabric is subjected to rotation of the knitting while either the front needle bed or the back needle bed being racked in a direction opposite to the direction of the needle bed being racked in the second step, and the loops in the joining region as transferred in the third step are sequentially transferred back to the opposed needle bed starting from the loop located at the end far from the first knitted fabric while the second knitted fabric being subjected to the rotation of the knitting for the loops of the second knitted fabric located at end portions thereof far from the first knitted fabric to be transferred to the opposed needle bed, those operations being repeated so that the loops can be arranged on an every two or three needle or an every needle basis in the joining region of the second knitted fabric.

In the case of knitting the second knitted fabric, the third knitted fabric, and the first knitted fabric sandwiched between the second and third knitted fabrics, followed by the joining of the first and second knitted fabrics and the joining of the first and third knitted fabrics, the following steps should preferably be included before the start of joining of the knitted fabrics:

(1) the first step that the loops in the joining region of one of the front knitted fabric part and the back knitted fabric part of the first knitted fabric to be joined to the second knitted fabric are transferred to the opposed needle bed, while also the loops in the joining region of the third knitted fabric having the gore, which corresponds in size to the joining rejoin of the first knitted fabric from which the loops were transferred, are transferred to the opposed needle bed, (2) the second step that the second knitted fabric is subjected to rotation of the knitting while either the front needle bed or the back needle bed being racked in either rightward or leftward, and the loops in the joining region as transferred in the first step are sequentially transferred back to the opposed needle bed starting from the loop located at the end far from the second knitted fabric while the first and third knitted fabrics being subjected to the rotation of the knitting for the loops of the first and third knitted fabrics located at end portions thereof far from the second knitted fabric to be transferred to the opposed needle bed, those operations being repeated so that the loops can be arranged on an every two or three needle or an every needle basis in the joining regions of the first knitted fabric and the third knitted fabric, (3) the third step that the loops in the joining region of the first knitted fabric to be joined to the third knitted fabric, which corresponds in size to the joining rejoin from which the loops were transferred in the first step, are transferred to the opposed needle bed, while also the loops in the joining region of the second knitted fabric, which corresponds in size to the joining rejoin of the first knitted fabric from which the loops were transferred, are transferred to the opposed needle bed, and (4) the fourth step that the third knitted fabric is subjected to rotation of the knitting while either the front needle bed or the back needle bed being racked in a direction opposite to the direction of the needle bed being racked in the second step, and the loops in the joining region as transferred in the third step are sequentially transferred back to the opposed needle bed starting from the loop located at the end far from the third knitted fabric while the first and second knitted fabrics being subjected to the rotation of the knitting for the loops of the first and second knitted fabrics located at end portions thereof far from the third knitted fabric to be transferred to the opposed needle bed, those operations being repeated so that the loops can be arranged on an every two or three needle or an every needle basis in the joining region of the first and second knitted fabrics.

The knitted fabric joining method of the present invention is characterized in that the joining region of the front knitted fabric part and the joining region of the back knitted fabric part are arranged and the loops in the joining region of the front knitted fabric part and the loops in the joining region of the back knitted fabric part are assigned to the joining regions containing needles in equal number on the opposed needle beds, respectively, so that before the start of the joining, the loops in the joining region of the small gore can be held on an every two or three needle basis and also the loops in the joining region of the large gore can be held on an every needle basis (including on a every needle in part basis). This can provide the result that the front knitted fabric part and the back knitted fabric part are always kept separate and held on the front needle bed and the back needle bed, respectively, before the start of the joining.

This knitting can facilitate the knitting of the knitted fabrics having the gores, while also providing good appearance and silhouette. In addition, this can prevent formation of twist in the loops at the boundaries between the front and back knitted fabric parts after completion of the joining and can also make the boundaries between the front and back knitted fabric parts in the joining regions substantially correspond to each other without being displaced from each other, as shown in FIG. 18.

The joining method of the present invention is applicable not only to the knitwear, such as tights and pants, whose tubular knitted fabrics are a right foot portion and a left foot portion, but also to the knitwear, such as sweaters, whose tubular knitted fabrics are a body and right and left sleeves.

In the knitted fabric having the body and the sleeves, such as the sweater, the respective joining regions of its front knitted fabric parts are increased in area, while on the other hand, in the pants, the joining region of its back knitted fabric parts are increased in area, thereby providing the knitwear easy to move.

Now, operation of the present invention will be explained. According to the present invention, for example when the tubular knitted fabric of the present invention is knitted with a four-bed flat knitting machine, at least two tubular knitted fabrics are knitted. In the joining step, those tubular knitted fabrics are supplied to the opposed needles beds, respectively, so that both ends of the joining region of the large gore and both ends of the joining region of the small region confront each other.

For example, when the tubular knitted fabric is knitted on an every needle basis using all needles, the loops are held on neighboring needles in the joining region of the large gore, and the loops are held on an every two or three needle basis in the joining region of the small gore containing the needles in the same number as those on which the loops in the joining rejoin of the large gore are held.

Even when the tubular knitted fabric is knitted on an every two or three needle basis, the loops are held on neighboring needles in the joining region of the large gore, while the loops are held on an every two or three needle basis in the joining region of the small gore containing the needles in the same number as those on which the loops in the joining rejoin of the large gore are held.

For example, the joining region of the small gore is switched from the state of the loops being held on an every needle basis to the state of the loops being held on an every two or three needle basis in the following manner. The loops in the joining region of the small gore are transferred to the opposed needle bed, first, and, then, after the needle bed is racked, the rotation is performed so that the joining region of the small gore is switched from the state of the loops being held in an every needle basis to the state of the loops being held on an every two or three needle basis. On the other hand, the joining region of the large gore is switched from the state of the loops being held on an every two or three needle basis to the state of the loops being held on an every needle basis in the following manner. The loops in the joining region of the large gore are transferred to the opposed needle bed, first, and, then, after the needle bed is racked, the rotation is performed so that the joining region of the large gore is switched from the state of the loops being held in an every two or three needle basis to the state of the loops being held on an every needle basis.

The rotation of the knitting for the joining region of one tubular knitted fabric to be switched to the state of the loops being held on an every two or three needle basis or an every needle basis and the rotation of the knitting for the joining region of the other tubular knitted fabric to be switched to the state of the loops being held on an every two or three needle basis or on an every needle basis are made opposite in rotation direction to each other.

This enables the rotation of knitting of a single tubular knitted fabric in both normal and reverse directions. Hence, the loops at both lateral ends of the front knitted fabric part can be placed in the front needle bed and the loops at both lateral ends of the back knitted fabric part can be placed in the back needle bed.

In the knitting using the four-bed flat knitting machine, after the tubular knitted fabrics are knitted on an every needle basis, the joining of the joining regions of the small gore starts with the loops in the joining regions of the small gore held on an every two needle basis.

In the knitting using the four-bed flat knitting machine, after the tubular knitted fabrics are knitted on an every two needle basis, the joining of the joining regions of the large gore can start with the loops in the joining regions of the large gore held on an every needle basis (not on an every two needle basis) and the loops in the joining regions of the small gore remaining held on an every two needle basis.

When the joining method of the present invention is employed using a two-bed flat knitting machine, the tubular knitted fabrics are knitted on an every three needle basis. In this case, the joining of the joining regions of the small gore can starts with the loops in the joining regions of the small gore held on an every third needle basis.

Then, after the joining region of the small gore is put in the state of being on an every two or three needle basis, the tubular knitted fabrics are joined together. Specifically, loops in the joining region of one tubular knitted fabric located at a lateral end portion thereof and loops in the joining region of the other tubular knitted fabric are overlapped with each other, these loops of the tubular knitted fabrics being to be joined to each other, are overlapped with each other in such a manner that the loops located adjacent to each other with respect to the boundary between the front knitted fabric part and the back knitted fabric part are overlapped with each other and the loops located far away from each other with respect to the boundary are overlapped with each other and then are subjected to the bind-off process, thereby joining together the both tubular knitted fabrics.

Different methods can be taken for the joining. One is that the knitting to bind off the one tubular knitted fabric to be joined from one lateral end thereof to the other lateral end thereof and the knitting to overlap the loops in the joining region of the other tubular knitted fabric with the loops in the joining region of the one knitted fabric from the loops located at their lateral ends so that their front knitted fabric parts can be overlapped with each other and their back knitted fabric parts can be overlapped with each other are performed concurrently. In this joining method, the knitting to overlap the loops in the joining regions with each other and the knitting for the bind-off process are performed concurrently, while the knitting to join together the joining regions of the front knitted fabric parts and the knitting to join together the joining regions of the back knitted fabric parts are performed independently.

Another one is that two tubular knitted fabrics to be joined together are rotated in the direction opposite to each other by rotation of the knitting, first, and, then, the loops in the joining regions of the both tubular knitted fabrics are held on the same needle bed. Then, while the knitting to bind off the one tubular knitted fabric to be joined from one lateral end thereof to the other lateral end thereof is performed, the loops in the joining region of the other tubular knitted fabric are overlapped with the loops in the joining region of the one knitted fabric from the loops located at their lateral ends so that their front knitted fabric parts can be overlapped with each other and their back knitted fabric parts can be overlapped with each other to join together the both tubular knitted fabrics.

In this joining method, the knitting to overlap the loops in the joining regions with each other and the knitting for the bind-off process are performed concurrently, while the joining of the joining regions of the front knitted fabric parts and the joining of the joining regions of the back knitted fabric parts are performed successively.

Joining together the tubular knitted fabrics by the joining methods mentioned above can provide the result that the loops in the joining region of the one tubular knitted fabric to be joined and the loops in the joining region of the other tubular knitted fabric can be overlapped with each other so that the loops located adjacent to each other with respect to the boundary between the front knitted fabric part and the back knitted fabric part can be overlapped with each other and the loops located far away from each other with respect to the boundary can be overlapped with each other. This can allow the one tubular knitted fabric to rotate around its gore with respect to the other tubular knitted fabric in a direction in which a space between the both knitted fabrics is spread at a larger angle than ever, thereby producing the knitwear that can allow a high freedom of body movement of a wearer as well as a comfortable fit.

BRIEF DESCRIPTION OF THE DRAWINGS

FIG. 19 is an Explanation of Letters or Numerals.

EMBODIMENTS OF THE INVENTION

Next, preferred embodiments of the present invention will be described with reference to the accompanying drawings. In the first to third embodiments described in the following, the knitting of knitted fabrics is performed using a flat knitting machine, what is called a four-bed flat knitting machine. The four-bed flat knitting machine includes an upper front needle bed and an upper back needle bed which are arranged over a lower front needle bed and a lower back needle bed, respectively, and on which a number of needles are arranged at the same pitches as in the lower beds.

The four-bed flat knitting machine can permit loops to be transferred between the lower front and back needle beds and between the lower and upper needle beds located in opposed positions, respectively. In the illustrated embodiments, the four-bed flat knitting machine of a type which can permit the back needle beds to be racked relative to the front needle beds is used.

It is noted that the third embodiment is an embodiment wherein the tubular knitted fabrics are knitted on an every two needle basis, and the joining of the joining regions of those tubular knitted fabrics starts, with the loops in the joining region of the large gore held on an every needle basis (not on an every two needle basis) and the loops in the joining region of the small gore remaining held on an every two needle basis.

Figure 1:
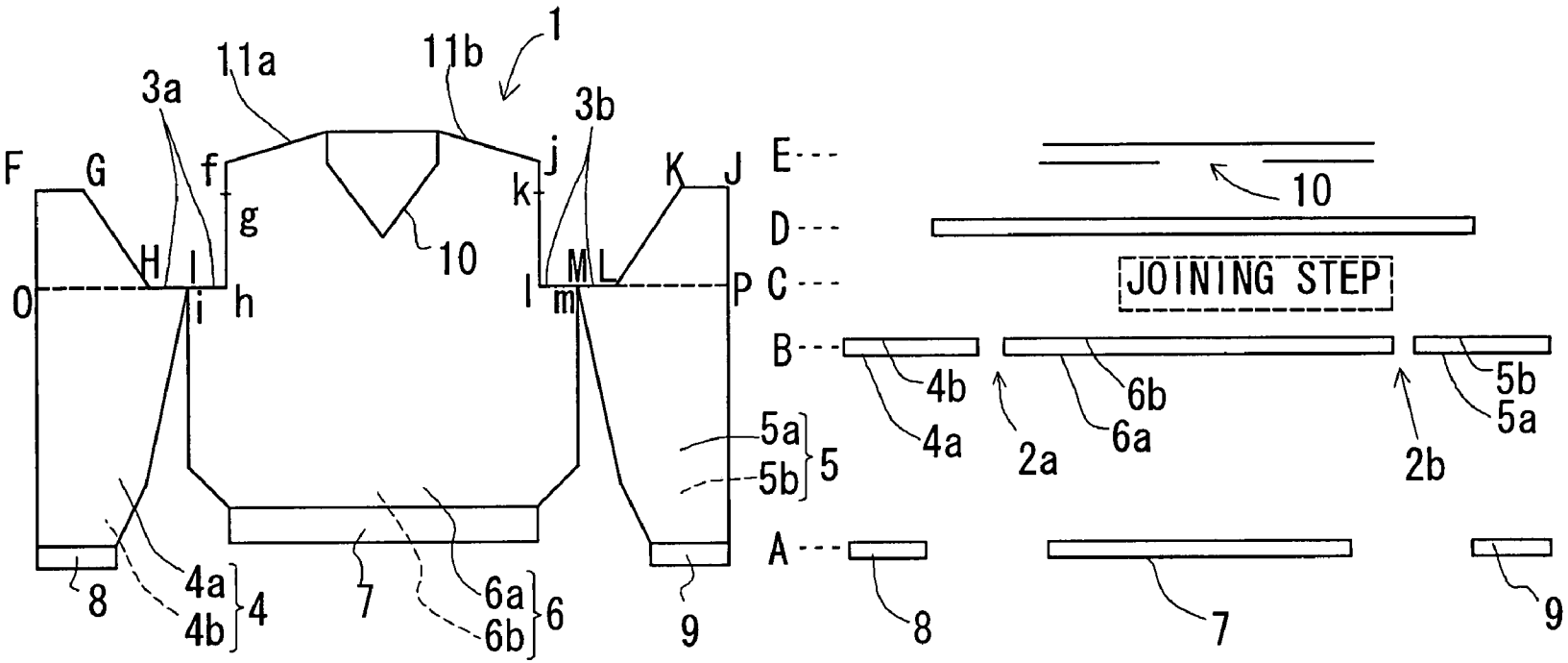
FIG. 1 is a development view of a sweater with gores and a knitting process drawing thereof.
Figure 2:
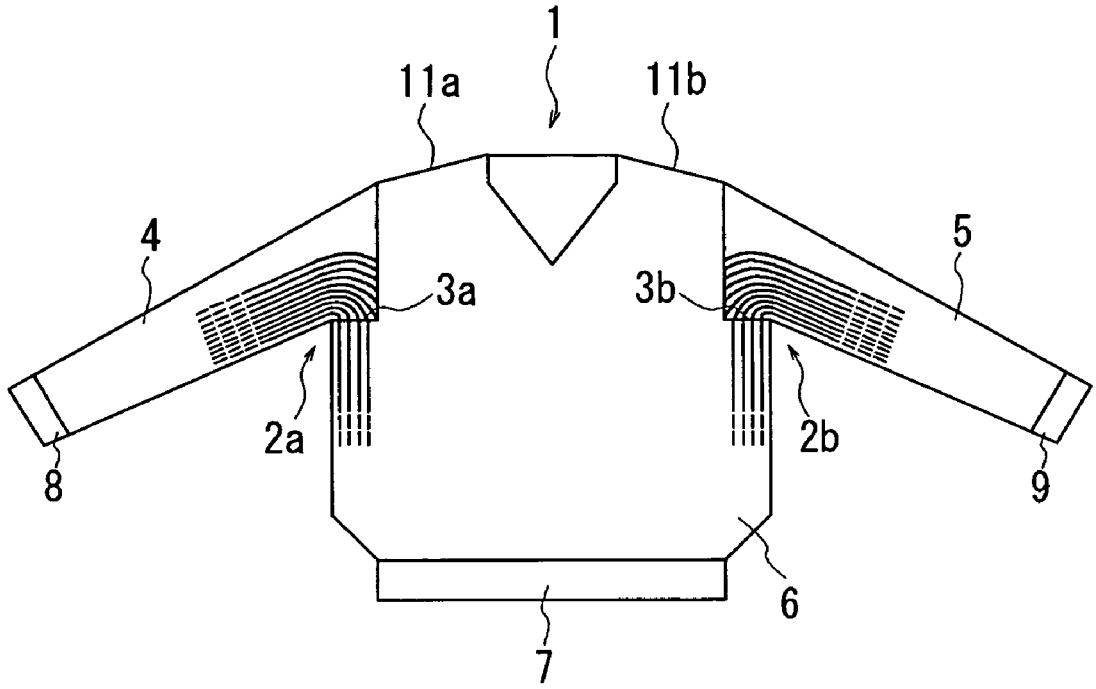
FIG. 2 is a drawing showing a finished sweater 1 of FIG. 1.

FIG. 1 is a development view and a knitting process drawing of a sweater 1 having gores 3*a*, 3*b* formed at side portions thereof 2*a*, 2*b* by the joining method of the illustrated embodiment, and FIG. 2 is a drawing showing a finished sweater 1. In FIG. 2, the directions of wales of sleeves 4, 5 and a body 6 extending are depicted at and around the gores 3*a*, 3*b*. This embodiment is directed to a joining method of joining knitted fabrics having gores where the joining regions (number of wales) of the front knitted fabric parts of the body and sleeves is different in size from the joining regions (number of wales) of the back knitted fabric parts of the body and sleeves.

The sweater 1 is knitted starting at a hem 7 of the body 6 and at cuffs 8, 9 of the right and left sleeves 4, 5 (Step A). The body 6 and the sleeves 4, 5 are each knitted in the form of a tubular knitted fabric until the start of joining of the sleeves 4, 5 and the body 6 at side portions thereof 2*a*, 2*b* (Step B).

After the knitting of the sleeves 4, 5 up to lines I-O and M-P is completed, the joining step proceeds (Step C). In the joining step, I-H of the right sleeve 4 and i-h of the body 6 are joined and also M-L of the left sleeve 5 and m-l of the body 6 are joined, whereby the gores 3*a*, 3*b* are formed.

In the illustrated embodiment, the joining regions are formed by I-H of the right sleeve 4, i-h of the body 6, M-L of the left sleeve 5, and m-l of the body 6. Further, the joining region (number of wales) of the front knitted fabric parts of the body and sleeves is formed to be larger in size than the joining regions (number of wales) of the back knitted fabric parts thereof, though not shown in FIGS. 1 and 2.

Sequentially, while the right and left sleeves 4, 5 and the body 6 are knitted in the form of a single tubular knitted fabric, the right sleeve 4 and the left sleeve 5 are shifted to the body 6 and joined thereto at H-G of the right sleeve 4 and h-g of the body and at L-K of the left sleeve 5 and l-k of the body 6, respectively (Step D).

After the end of the step D, G-F of the right sleeve 4 and K-J of the left sleeve 5 are joined to g-f and k-j of the body, respectively (Step E). In this step E, the yarn feed to the sleeves 4, 5 is finished, and the sleeves 4, 5 are shifted to and joined to the body 6 each time a proper number of courses of the body 6 is knitted.

After completion of the joining of the sleeves 4, 5 and the body 6, the front body 6*a* having a neckline opening 10 and the back body 6*b* are joined together at right and left shoulder parts thereof 11*a*, 11*b*. The knitting of the sweater 1 is ended with this. In the following, an example using the joining step of joining together the sleeves 4, 5 and the body 6 in such a manner as to form the gores 3*a*, 3*b* therebetween is illustrated as the first embodiment, and an example using the joining step of joining together right and left foot parts of pants in such a manner as to form the gore therebetween is illustrated as the second embodiment. As the knitting steps other than the joining process steps are known, only the knitting steps in the joining process steps are described here.

Figure 3:
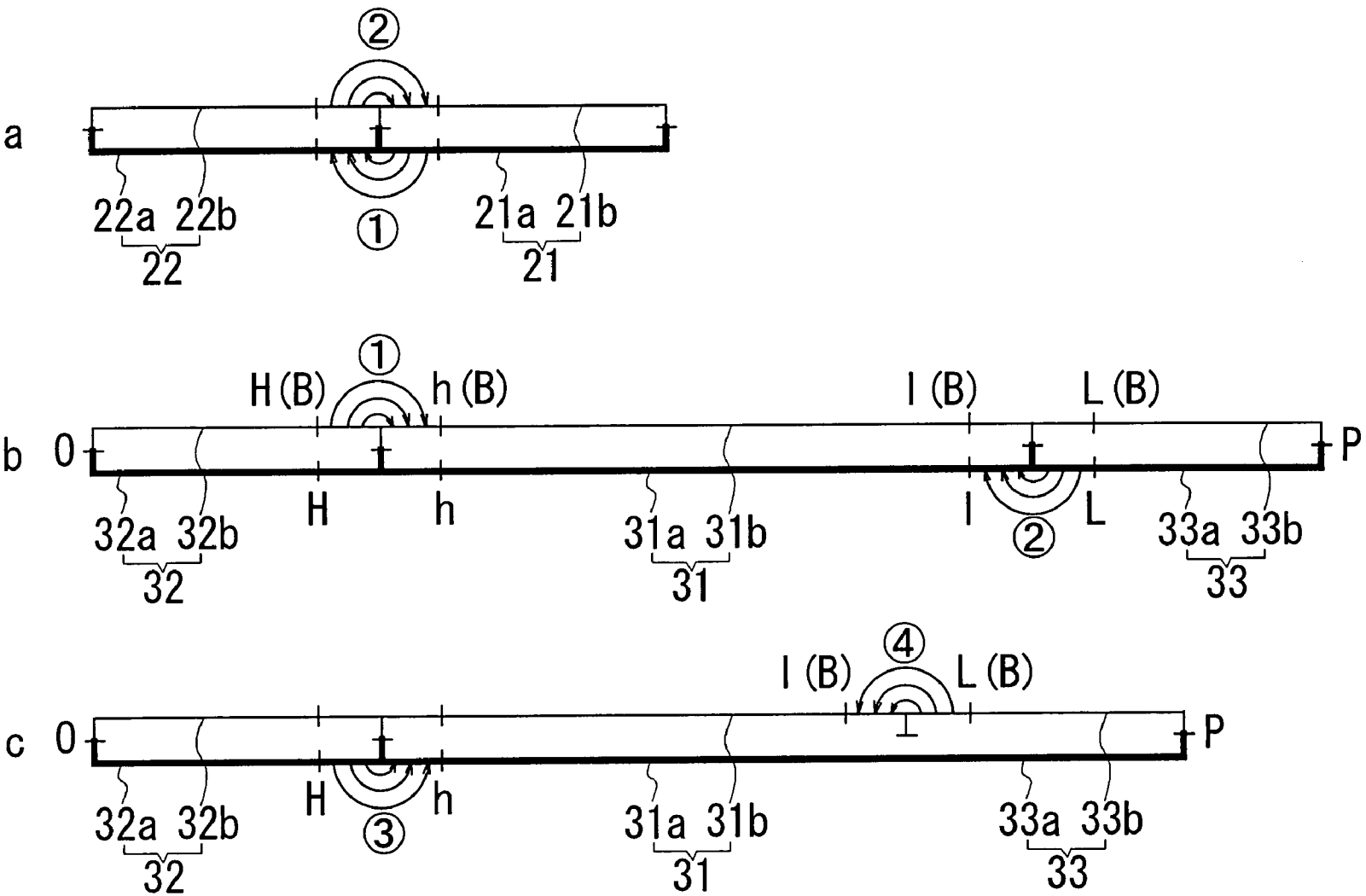
FIG. 3 is the knitting step drawing, FIG. 3(*a*) showing the step of forming gores in pants of a second embodiment, and FIG. 3(*b*) and FIG. 3(*c*) showing the steps of forming gores in a sweater of a first embodiment.

Further, the present invention provides two different knitting methods, one for joining together two knitted fabrics and the other for joining together three knitted fabrics. The outlines of the respective knitting methods are described with reference to FIG. 3. FIG. 3*a* shows the knitting for joining together the two knitted fabrics, and FIGS. 3*b* and 3*c* show the knitting for joining together the three knitted fabrics.

In the joining of the two knitted fabrics, the gores 3*a*, 3*b* are formed by the knitting ① wherein a front knitted part 21*a* of a first knitted fabric 21 is shifted toward a front knitted fabric part 22*a* of a second knitted fabric 22, followed by the joining, and the knitting ② wherein the back knitted fabric part 22*b* of the second knitted fabric 22 is shifted toward the back knitted fabric part 21*b* of the first knitted fabric 21, followed by the joining. The knitting ① and the knitting ② may be performed simultaneously or sequentially. When the knitting ① and the knitting ② are performed simultaneously, the number of times the needle bed is racked can be reduced, thus providing the efficient knitting.

In the illustrated embodiment, in particular, even when there is difference in size between the joining region of the front knitted fabric part and the joining region of the back knitted fabric part, the knitting ① and the knitting ② can be performed simultaneously. This is because no difference in total number of needles between the joining region of the front knitted fabric part and the joining region of the back knitted fabric part is made by holding the loops in the joining region of the small gore on an every two or three needle basis so that before the start of joining, the front and back joining regions on the needle beds can substantially correspond in size to each other.

In the joining of the three knitted fabrics, for example, the knitting ① wherein a back knitted fabric part 32*b* of a second knitted fabric 32 is shifted toward a back knitted fabric part 31*b* of a first knitted fabric 31, followed by the joining, and the knitting ② wherein a front knitted fabric part 33*a* of a third knitted fabric 33 is shifted toward the front knitted fabric part 31*a* of the first knitted fabric 31, followed by the joining, are performed, first, as shown in FIG. 3(*b*).

Then, the knitting ③ wherein the front knitted fabric part 32*a* of the second knitted fabric 32 is shifted toward the front knitted fabric part 31*a* of the first knitted fabric 31, followed by the joining, and the knitting ④ wherein the back knitted fabric part 33*b* of the third knitted fabric 33 is shifted toward the back knitted fabric part 31*b* of the first knitted fabric 31, followed by the joining, are performed, as shown in FIG. 3(*c*). The gores 3*a*, 3*b* are formed each time the knitting ①-④ is performed.

The knitting ①-④ may be performed in any preferred sequence. As shown in FIG. 3, the knitting ① and ② and the knitting ③ and ④ may be performed simultaneously or sequentially, or the knitting ①-④ may be performed in a free sequence. When the knitting ① and ② are performed concurrently, followed by the knitting ③ and ④, and vice versa, the number of times the needle bed is racked can be reduced, thus providing the efficient knitting.

In the joining of the three knitted fabrics as well, even when there is difference in size between the joining region of the front knitted fabric part and the joining region of the back knitted fabric part, no difference in total number of needles between the joining region of the front knitted fabric part and the joining region of the back knitted fabric part is made by holding the loops in the joining region of the small gore on an every two or three needle basis so that before the start of joining, the front and back joining regions on the needle beds can substantially correspond in size to each other.

In the following, the joining method for joining together three knitted fabrics of the sweater having the body and the sleeves is illustrated in the first embodiment, and the joining method for joining together two knitted fabrics of pants is illustrated in the second embodiment.

First Embodiment

The knitting of joining together the three tubular knitted fabrics in such a manner as to form the gores 3*a*, 3*b* of the sweater 1 of FIG. 1 is explained with reference to FIGS. 4-10. The sweater of the first embodiment is knitted so that the gore of the front knitted fabric part can be larger in size (volume) than that of the back knitted fabric part. Specifically, the gore of the front knitted fabric part has the size of eight wales and the gore of the back knitted fabric part has the size of four wales.

In this embodiment, in order to form the gores, the knitting of the knitted fabric of the body 6 being subjected to the bind-off process from one lateral end thereof to the other lateral end thereof, the knitting of the loops in the joining region of the body 6 located on the right side side and the loops in the joining region of the knitted fabric of the right sleeve 4 being overlapped with each other from the lateral ends thereof so that their front knitted fabric parts can be overlapped with each other and their back knitted fabric parts can be overlapped with each other, and the knitting of the loops in the joining region of the body 6 located on the left side side and the loops in the joining region of the knitted fabric of the left sleeve 5 being overlapped with each other from the lateral ends thereof so that their front knitted fabric parts can be overlapped with each other and their back knitted fabric parts can be overlapped with each other are performed concurrently.

Further, in the first embodiment, the knitting of the loops in the joining regions being overlapped with each other and the knitting of those loops being subjected to the bind-off process are performed concurrently, while on the other hand, the joining of the joining regions of their front knitted fabric parts and the joining of the joining regions of their back knitted fabric parts are performed separately. In other words, in this embodiment, the knitting ① and ② of FIG. 3(*b*) are performed concurrently, first, and, then. the knitting ③ and ④ of FIG. 3(*c*) are performed concurrently.

The numerals at the left side of FIGS. 4-10 indicate the serial number of knitting steps, and the alphabetical characters FU, FD, BD, and BU indicate a front upper needle bed, a front lower needle bed, a back lower needle bed, and a back upper needle bed, respectively.

Figure 4:
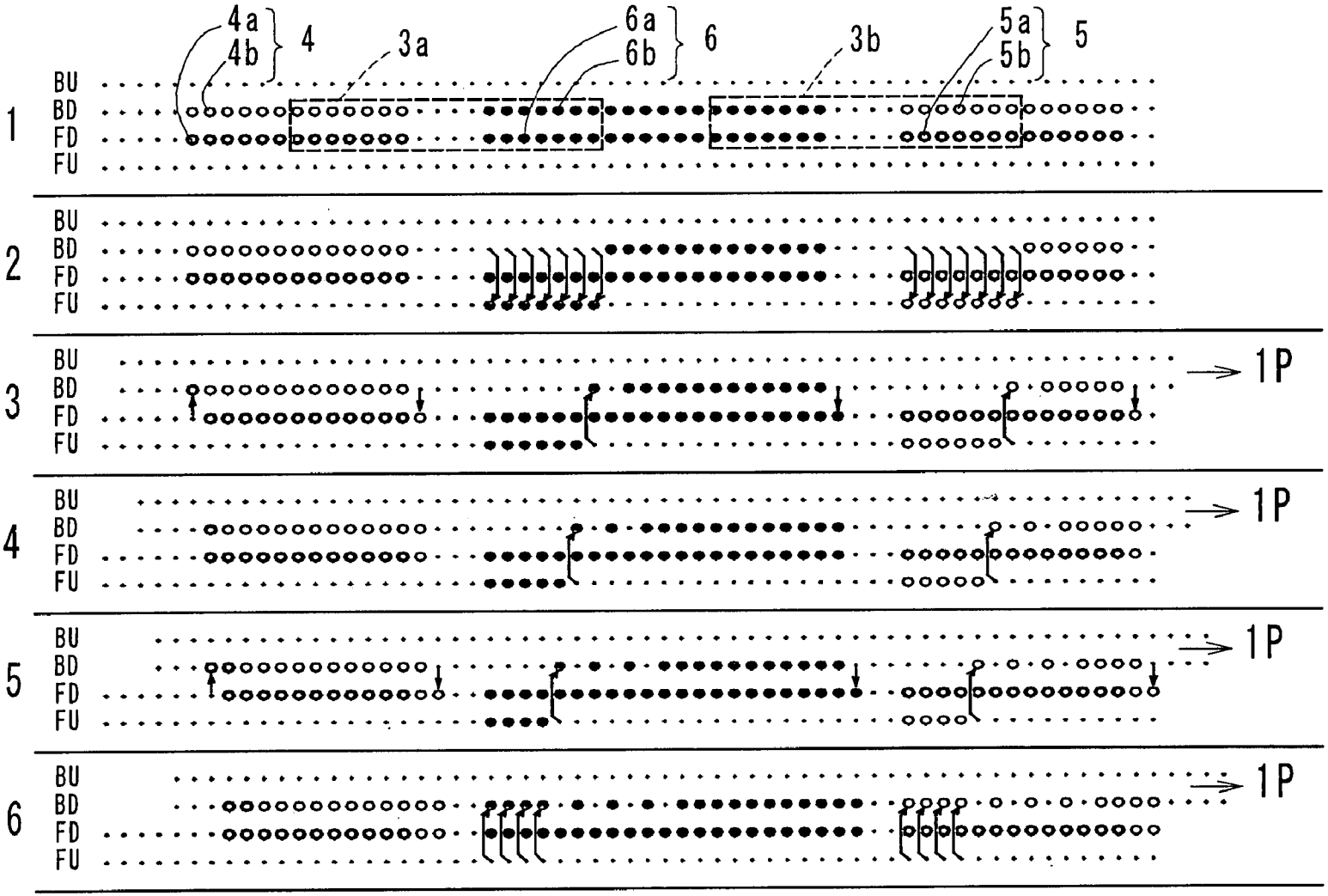
FIG. 4 is a knitting course drawing showing the joining of three knitted fabrics according to the first embodiment.
Figure 5:
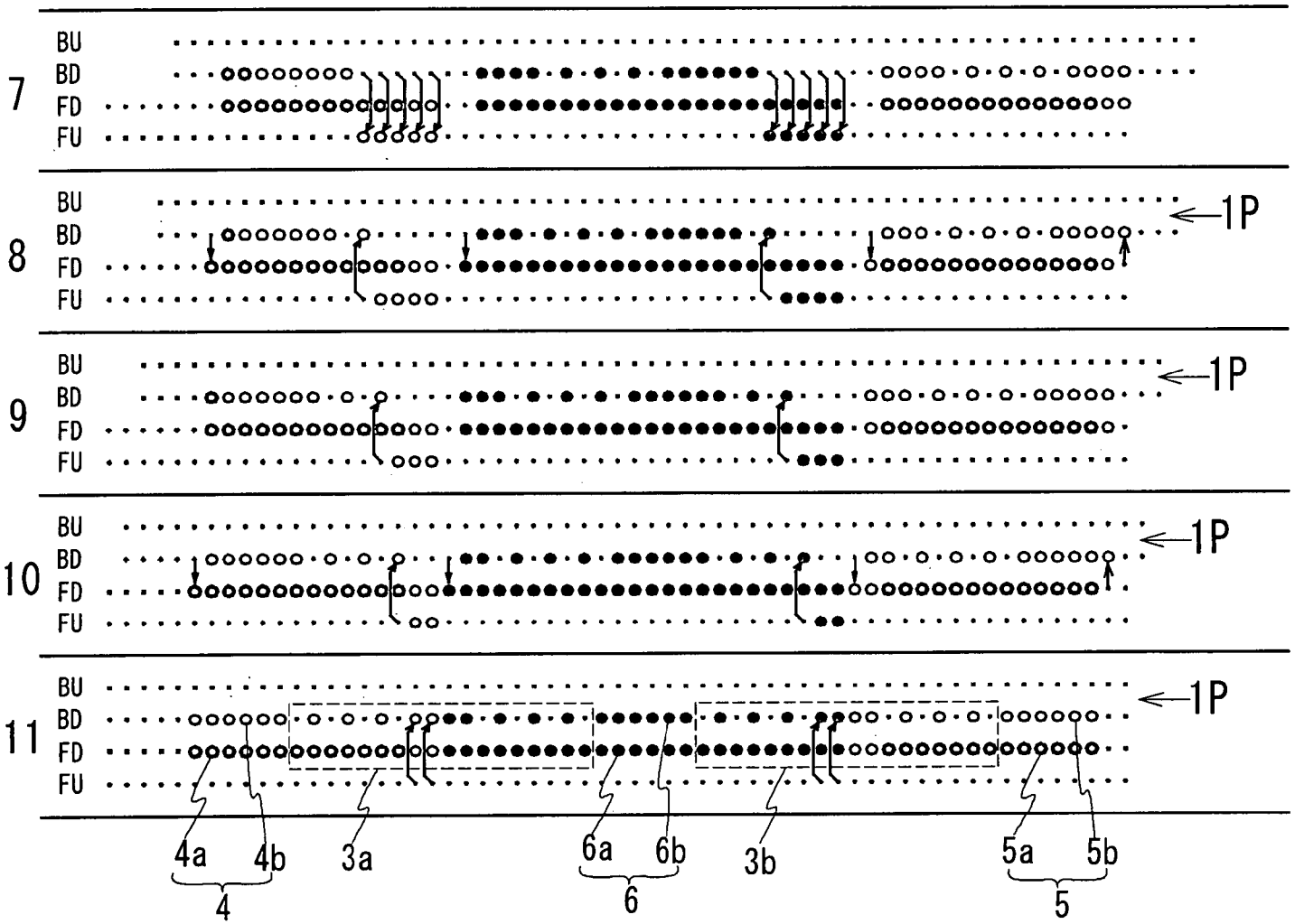
FIG. 5 is a knitting course drawing showing the joining of three knitted fabrics according to the first embodiment.
Figure 6:
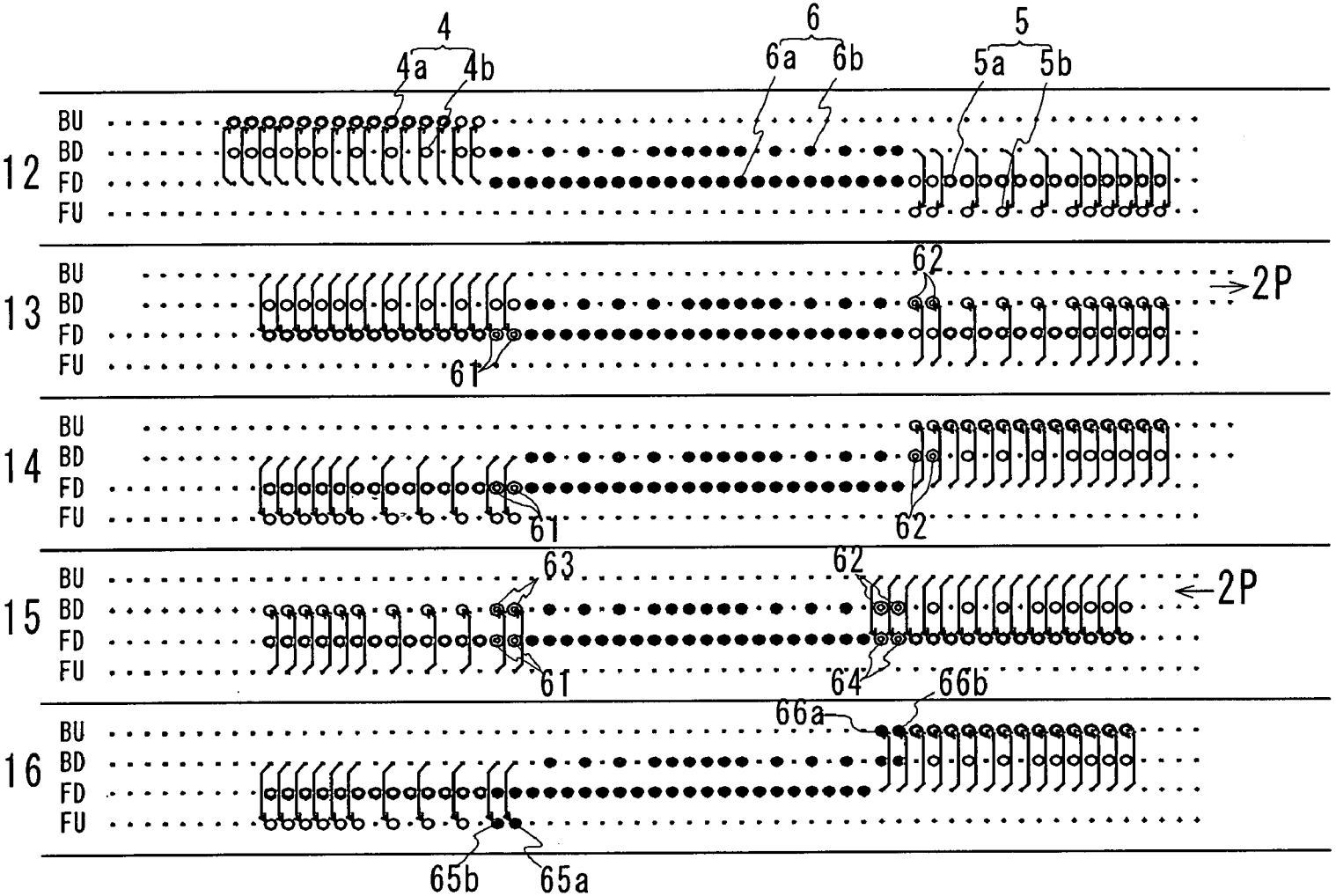
FIG. 6 is a knitting course drawing showing the joining of three knitted fabrics according to the first embodiment.
Figure 7:
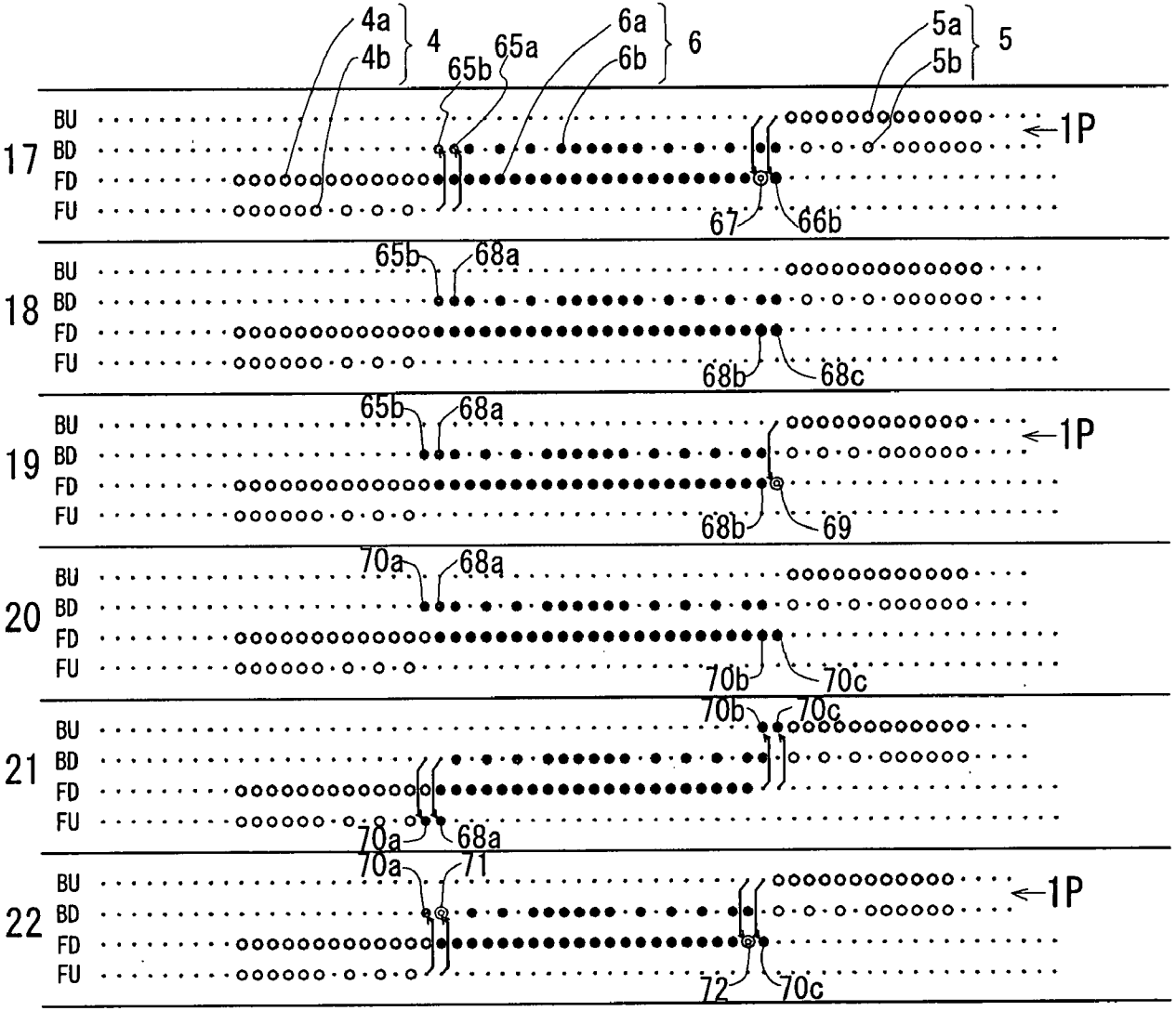
FIG. 7 is a knitting course drawing showing the joining of three knitted fabrics according to the first embodiment.
Figure 8:
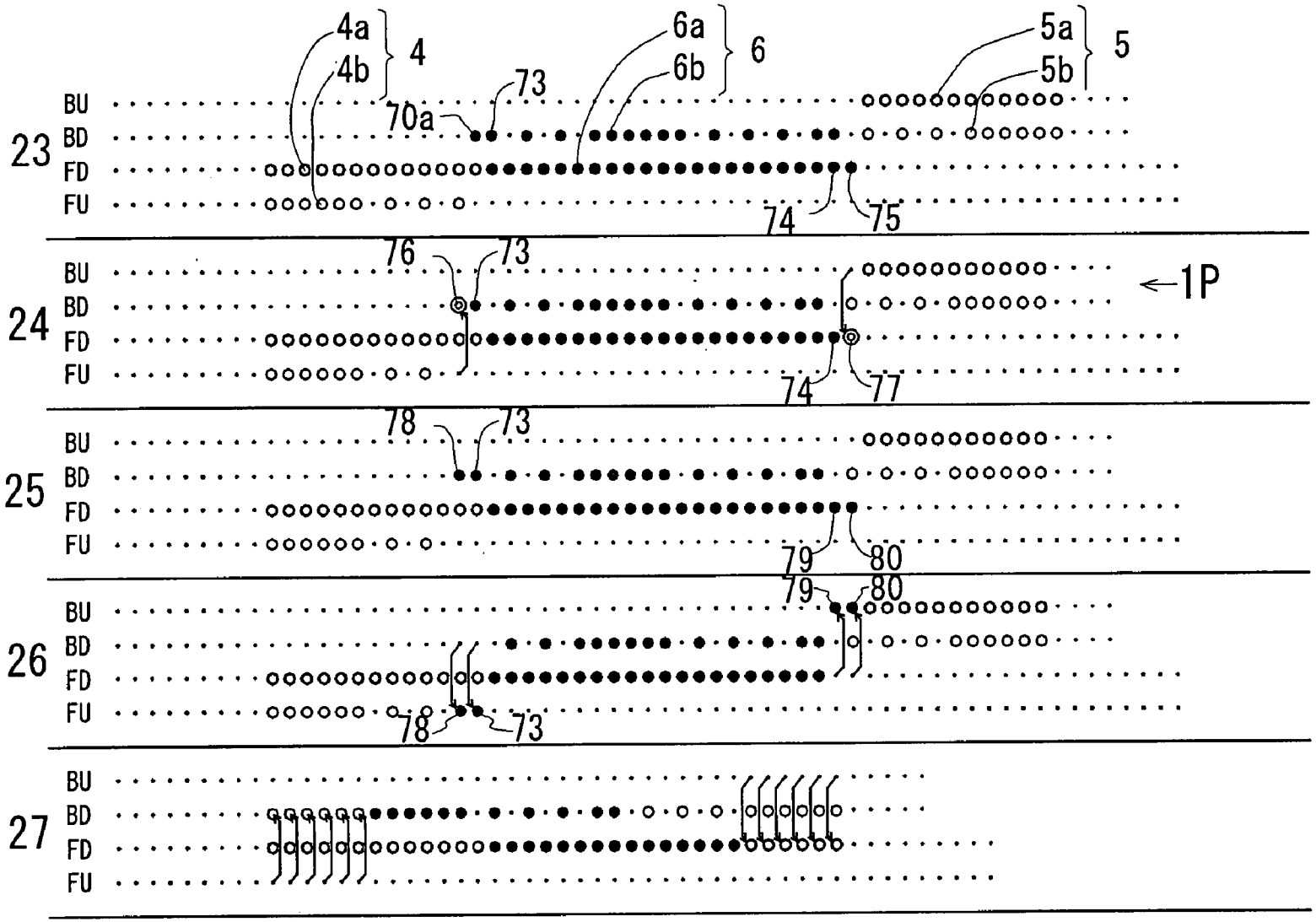
FIG. 8 is a knitting course drawing showing the joining of three knitted fabrics according to the first embodiment.
Figure 9:
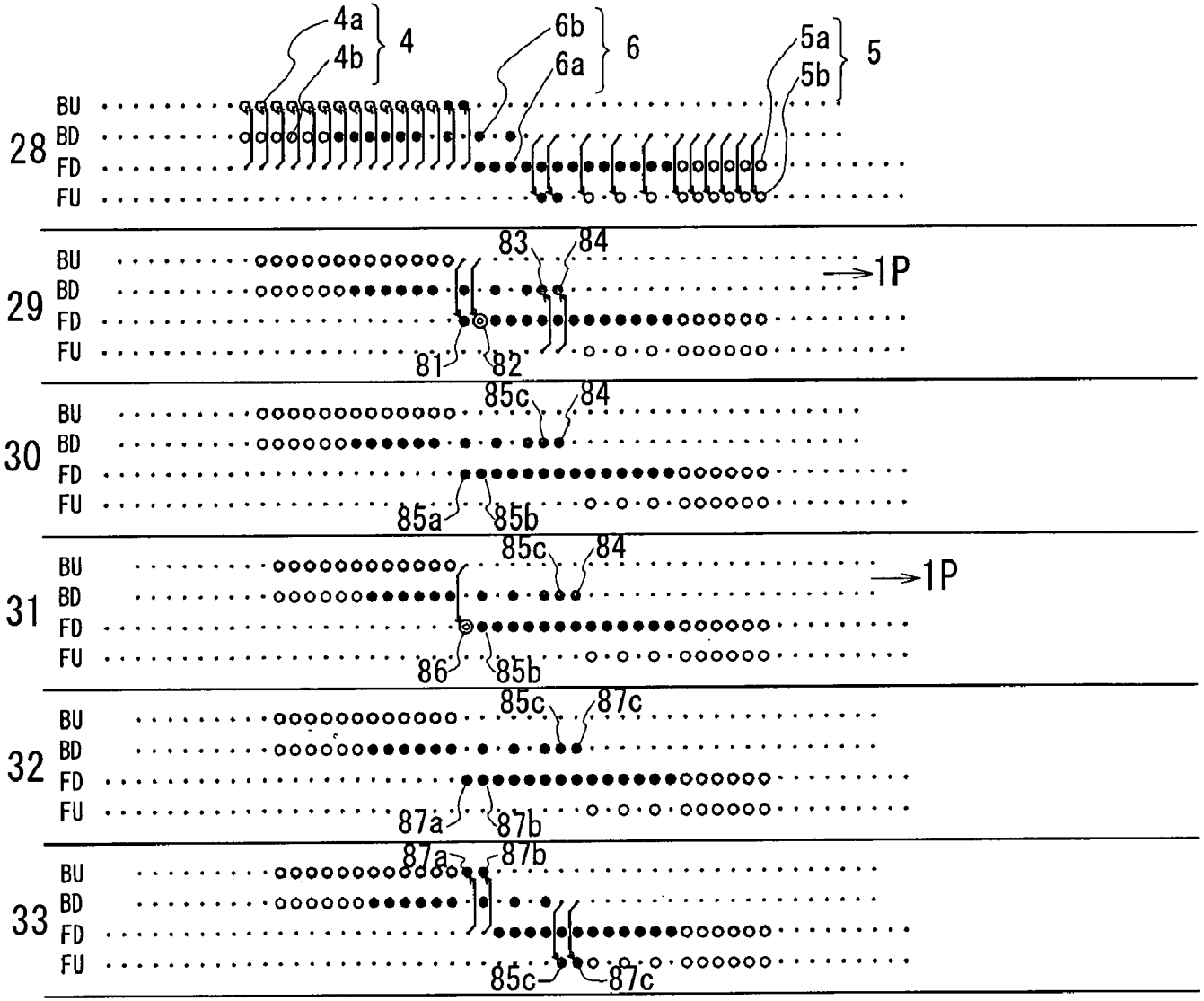
FIG. 9 is a knitting course drawing showing the joining of three knitted fabrics according to the first embodiment.
Figure 10:
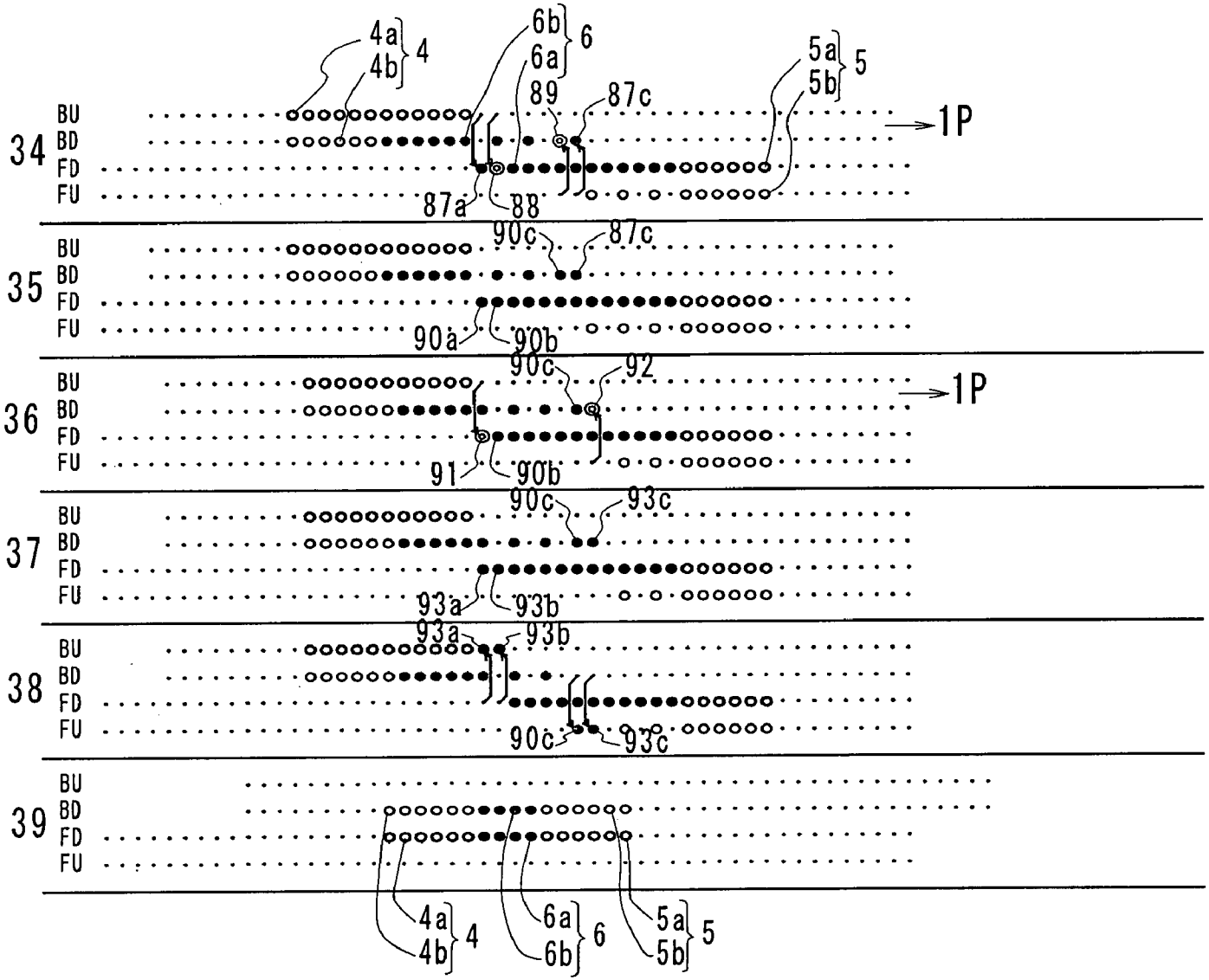
FIG. 10 is a knitting course drawing showing the joining of three knitted fabrics according to the first embodiment.

The step 1 shown in FIG. 4 shows the initial state before formation of the gores 3*a*, 3*b* starts. The loops surrounded by a chain line 3*a* on the left side are the loops in the joining region for the gore 3*a* to be formed, and the loops surrounded by a chain line 3*b* on the right side are the loops for the gore 3*b* to be formed.

As to the gores 3*a*, 3*b* shown in the step 1, a part of the loops in the joining regions of the back knitted fabric parts held on the back needle bed are eventually used for the gores of the front knitted fabric parts. The joining region of the back knitted fabric part is less in number of needles. In order that the joining region of the back knitted fabric part can contain as many needles as the needles used in the joining region of the front knitted fabric part, the loops in the joining region of the small gore are shifted in the next step so that the loops in the joining region of the small gore can be held on an every two needle basis on the back needle bed.

First, in the step 2, the loops in the joining region of the back knitted fabric part of the body 6 located on the right sleeve side are transferred to the front upper needle bed FU and also the loops in the joining region of the back knitted fabric part of the left sleeve 5 are transferred to the front upper needle bed FU.

In the step 3, after the back needle bed is racked rightward one pitch, the right sleeve 4 is subjected to rotation of the knitting in such a manner that a loop of its back knitted fabric part located at an end thereof on the body side is transferred to the front lower needle bed FD at a position next to a loop of its front knitted fabric part located at an end thereof, while also a loop of its front knitted fabric part located at an outer end thereof is transferred to the back lower needle bed BD at a position adjacent to a loop of the back knitted fabric part located at a lateral end thereof.

Further, while the body 6 and the left sleeve 5 are subjected to rotation of the knitting in such a manner that loops of their back knitted fabric parts located at ends thereof on the right-hand side as viewed in FIG. 4 are transferred to positions adjacent to loops of their front knitted fabric parts on the front lower needle bed FD located at lateral ends thereof, one of the loops of the body 6 and one of the loops of the left sleeve 5 in their joining regions on the front upper needle bed FU, which are located at ends thereof far away from the right sleeve 4, are transferred back to the back lower needle bed BD.

In the step 4, after the back needle bed is racked rightward one pitch, one of the loops of the body 6 and one of the loops of the left sleeve 5 in their joining regions on the front upper needle bed FU, which are located at ends thereof far away from the right sleeve 4, are transferred back to the back lower needle bed BD. In the step 5, the same operation as in the step 3 is performed.

When there are many loops in the joining regions, the racking of the needle bed and the loop transfer in the steps 4 to 5 are repeatedly performed. As a result of the operations of racking and loop transfer in the steps 4 to 5, the loops in the joining region of the back knitted fabric part of the body 6 having the small gore located on the right sleeve side and the loops in the joining region of the back knitted fabric part of the left sleeve 5 are put in the state of being held on an every two needle basis, respectively.

Then, in the step 6, after the back needle bed is racked rightward one pitch, the remaining loops held on the front upper needle bed FU are transferred back to the back lower needle bed BD. Then, the joining region of the body 6 located on the left sleeve side and the joining region of the right sleeve 4 are subjected to the same racking and loop transfer operation as in the steps 2 to 6 (Steps 7 to 11). In this step, the racking direction is opposite to the racking direction in the steps 2 to 6.

In the step 11, the loops in the joining region of the small gore of the back knitted fabric part of the body 6 located on the left sleeve side and the loops in the joining region of the small gore of the back knitted fabric part of the right sleeve 4 are also put in the state of being held on an every two needle basis. The zones surrounded with dotted frames 3*a*, 3*b* are the joining regions, as shown in the step 11 and, as a result, the number of loops (number of wales) of each of the joining regions of the back knitted fabric parts are decreased by four loops below the number of loops (number of wales) of each of the joining regions of the front knitted fabric parts.

Although the number of loops of the joining regions of the back knitted fabric parts are decreased like this, the tubular knitted fabrics can be arranged on the needle beds substantially symmetrically with respect to lengths of their front and back knitted fabric parts. Also, the loops of the right sleeve 4 and the left sleeve 5 located at the ends on the side thereof opposite to the body are prevented from being shifted to the opposed needle beds, thus being put in the same state as in the step 1.

In this embodiment, the loops of the respective sleeves located at the ends on the side thereof opposite to the body can be put in the same state as in the step 1, remaining stayed at the ends of their front and back knitted fabric parts. Thus, the loops are prevented from being put in the state of being shifted to the opposed needle beds, preventing formation of twist in the loops, different from the prior art. Hence, even before the start of the joining, new loops can be formed in the sleeve while avoiding formation of twist in the old loops. When new loops, e.g. one course, can be formed before the start of the joining, there can be produced the result that even if double loops are formed in the sleeve in advance of the start of the joining, new loops can be formed readily following release of those double loops from the needles. Thus, the loop transfer can be achieved by these new loops thus formed, thus facilitating the knitting.

Then, the formation of the gores 3*a*, 3*b* is started from this state. First, in the steps 12 to 15, the joining of the sleeves and the body is provided by the double loops. In the step 12, the front knitted fabric part 4*a* of the right sleeve is transferred to the back upper needle bed BU and also the back knitted fabric part 5*b* of the left sleeve is transferred to the front upper needle bed FU simultaneously. In the step 13, after the back needle bed is racked rightward two pitches, the front knitted fabric part 4*a* of the right sleeve is transferred to the front lower needle bed FD and also the back knitted fabric part 5*b* of the left sleeve is transferred to the back lower needle bed BD simultaneously. As a result of this loop transfer, two loops of each sleeve located at its lateral end are overlapped with two loops of the body located at its lateral ends (loops 61, 62).

In the step 14, the back knitted fabric part 4*b* of the right sleeve is transferred to the front upper needle bed FU and also the front knitted fabric part 5*a* of the left sleeve is transferred to the back upper needle bed BU simultaneously. In the step 15, after the back needle bed is racked leftward two pitches, the back knitted fabric part 4*b* of the right sleeve is transferred to the back lower needle bed BD and also the front knitted fabric part 5*a* of the left sleeve is transferred to the front lower needle bed FD simultaneously. As a result of this loop transfer, two loops of the each sleeve located at its lateral end are overlapped with two loops of the body located at its lateral ends (loops 63, 64).

Then, new loops are formed following the formation of the loops 61, 63, by feeding a yarn from a yarn feeder used for the knitting of the body to the needle on which the four double loops 61, 63 on the right sleeve side are held, and also new loops are formed following the formation of the loops 62, 64, by feeding another yarn from another yarn feeder used for the knitting of the left sleeve to the needle on which the four double loops 62, 64 on the left sleeve side are held, though not shown.

It is to be noted that in the illustrated embodiment, the right and left gore forming regions are subjected to the bind-off process using the separate yarn feeders, though not shown in the knitting process drawing.

Then, in the step 16, the back knitted fabric part 4*b* of the right sleeve and two new loops 65*a*, 65*b* formed adjacent thereto are transferred to the front upper needle bed FU and also the front knitted fabric part 5*a* of the left sleeve and two new loops 66*a*, 66*b* formed adjacent thereto are transferred to the back upper needle bed BU simultaneously.

In the step 17, after the back needle bed is racked leftward one pitch, the loops 65*a*, 65*b* held on the front upper needle bed FU are transferred to the back lower needle bed BD and also the loops 66*a*, 66*b* held on the back upper needle bed BU are transferred to the front lower needle bed FD. As a result of this transfer of the loop 66*a*, a double loop 67 is formed.

In the step 18, a new loop 68*a* is formed following the loop 65*a* on the back lower needle bed BD, and new loops 68*b*, 68*c* are formed following the loops 67, 66*b* on the front lower needle bed FD. In the step 19, after the back needle bed is further racked leftward one pitch, the loop of the front knitted fabric part 5*a* of the left sleeve located at its end on the body side is transferred to the front lower needle bed FD. As a result of this loop transfer, a double loop 69 is formed.

In the step 20, a new loop 70*a* is formed following the loop 65*b* on the back lower needle bed BD, and new loops 70*b*, 70*c* are formed following the loops 68*b*, 69 on the front lower needle bed FD.

Then, in the step 21, the loops 70*a*, 68*a* held on the back lower needle bed BD are transferred to the front upper needle bed FU and the loops 70*b*, 70*c* held on the front lower needle bed FD are transferred to the back upper needle bed BU.

In the step 22, after the back needle bed is racked leftward one pitch, the loops 70*a*, 68*a* held on the front upper needle bed FU are transferred to the back lower needle bed BD and the loops 70*b*, 70*c* held on the back upper needle bed BU are transferred to the front lower needle bed FD. As a result of the transfer of the loop 68*a*, a double loop 71 is formed, and as a result of the transfer of the loop 70*b*, a double loop 72 is formed.

Then, in the step 23, the yarn is fed from the one yarn feeder to the needle holding the loop 71 thereon, to form a new loop 73 following the loop 71 and also the yarn is fed from the other yarn feeder to the needles holding the loops 72, 70*c* thereon, to form new loops 74, 75 following the loops 72, 70*c*.

In the step 24, after the back needle bed is racked leftward one pitch, the loop at the right end held on the front upper needle bed FU is transferred to the back lower needle bed BD and overlapped with the loop 70*a* (loop 76). Also, the loop at the left end held on the back upper needle bed BU is transferred to the front lower needle bed FD and overlapped with the loop 75 (loop 77).

Then, in the step 25, the yarn is fed from the one yarn feeder to the needle holding the loop 76 thereon, to form a new loop 78 following the loop 76 and also the yarn is fed from the other yarn feeder to the needles holding the loops 74, 77 thereon, to form new loops 79, 80 following the loops 74, 77.

Then, in the step 26, the loops 78, 73 held on the back lower needle bed BD are transferred to the front upper needle bed FU and the loops 79, 80 held on the front lower needle bed FD are transferred to the back upper needle bed BU.

The operations in the steps 17 to 26 are repeatedly performed. When all the loops are gone in the joining regions, the back knitted fabric part 4*b* of the right sleeve 4 held on the front upper needle bed FU and the front knitted fabric part 5*a* of the left sleeve 5 held on the back upper needle bed BU are transferred to the back lower needle bed BD and the front lower needle bed FD, respectively, as shown in the step 27.

In the operations described so far, the joining of the back knitted fabric part 4*b* of the right sleeve 4 and the back knitted fabric part 6*b* of the body 6, the joining of the front knitted fabric part 5*a* of the left sleeve 5 and the front knitted fabric part 6*a* of the body 6, and the bind-off process of the body 6 are performed concurrently.

Next, in the steps 28 to 39, the joining of the front knitted fabric part 4*a* of the right sleeve 4 and the front knitted fabric part 6*a* of the body 6, the joining of the back knitted fabric part 5*b* of the left sleeve 5 and the back knitted fabric part 6*b* of the body 6, and the bind-off process of the body 6 are performed.

In the step 28, two loops, i.e., one loop of the front knitted fabric part 4*a* of the right sleeve and one loop of the front knitted fabric part 6*a* of the body located at its end on the right sleeve side, are transferred to the back upper needle bed BU and also two loops, i.e., one loop of the back knitted fabric part 5*b* of the left sleeve and one loop of the back knitted fabric part 6*b* of the body located at its end on the left sleeve side, are transferred to the front upper needle bed FU simultaneously.

In the step 29, after the back needle bed is racked rightward one pitch, two loops of the front knitted fabric part 6*a* of the body located at an end portion thereof on the right sleeve side held on the back upper needle bed BU are transferred to the front lower needle bed FD (loops 81, 82). Also, two loops of the back knitted fabric part 6*b* of the body located at an end portion thereof on the left sleeve side held on the front upper needle bed FU are transferred to the back lower needle bed BD (loops 83, 84). Of these loops, the loop 82 operates to form a double loop. In the step 30, new loops 85*a*, 85*b* are formed following the loops 81, 82 on the front lower needle bed FD and a new loop 85*c* is formed following the loop 83 on the back lower needle bed BD.

In the step 31, after the back needle bed is further racked rightward one pitch, a loop of the front knitted fabric part 4*a* of the right sleeve located at an end thereof on the body side is transferred to the front lower needle bed FD. As a result of this loop transfer, a double loop 86 is formed. In the step 32, new loops 87*a*, 87*b* are formed following the loops 86, 85*b* on the front lower needle bed FD and also a new loop 87*c* is formed following the loop 84 on the back lower needle bed BD.

Then, in the step 33, the loops 87*a*, 87*b* held on the front lower needle bed FD are transferred to the back upper needle bed BU and also the loops 85*c*, 87*c* held on the back lower needle bed BD are transferred to the front upper needle bed FU.

In the step 34, after the back needle bed is racked rightward one pitch, the loops 87*a*, 87*b* held on the back upper needle bed BU are transferred to the front lower needle bed FD and also the loops 85*c*, 87*c* held on the front upper needle bed FU are transferred to the back lower needle bed BD. As a result of the transfer of this loop 87*b*, a double loop 88 is formed. Also, as a result of the transfer of the loop 85*c*, a double loop 89 is formed.

Then, in the step 35, new loops 90*a*, 90*b* are formed following the loops 87*a*, 88 on the front lower needle bed FD and also a new loop 90*c* is formed following the loop 89 on the back lower needle bed BD.

In the step 36, after the back needle bed is racked rightward one pitch, the loop of the front knitted fabric part of the right sleeve located at the right end and held on the back upper needle bed BU is transferred to the front lower needle bed FD and overlapped with the loop 90*a* (loop 91). Also, the loop of the back knitted fabric part of the left sleeve located at the left end and held on the front upper needle bed FU is transferred to the back lower needle bed BD and overlapped with the loop 87*c* (loop 92).

Then, in the step 37, new loops 93*a*, 93*b* are formed following the loops 91, 90*b* on the front lower needle bed FD and also a new loop 93*c* is formed following the loop 92 on the back lower needle bed BD.

Then, in the step 38, the loops 93*a*, 93*b* held on the front lower needle bed FD are transferred to the back upper needle bed BU and also the loops 90*c*, 93*c* held on the back lower needle bed BD are transferred to the front upper needle bed FU.

The operations in the steps 29 to 38 are repeatedly performed. When all the loops are gone in the joining regions, the front knitted fabric part 4*a* of the right sleeve 4 held on the back upper needle bed BU and the back knitted fabric part 5*b* of the left sleeve 5 held on the front upper needle bed FU are transferred to the front lower needle bed FD and the back lower needle bed BD, respectively, as shown in the step 39.

In the operations of the steps 27 to 39, the joining of the front knitted fabric part 4*a* of the right sleeve 4 and the front knitted fabric part 6*a* of the body 6, the joining of the back knitted fabric part 5*b* of the left sleeve 5 and the back knitted fabric part 6*b* of the body 6, and the bind-off process of the body are performed concurrently. When the joining is completed, the knitted fabrics are put in the state shown in the step 39 and the formation of the gores is completed.

Second Embodiment

Figure 11:
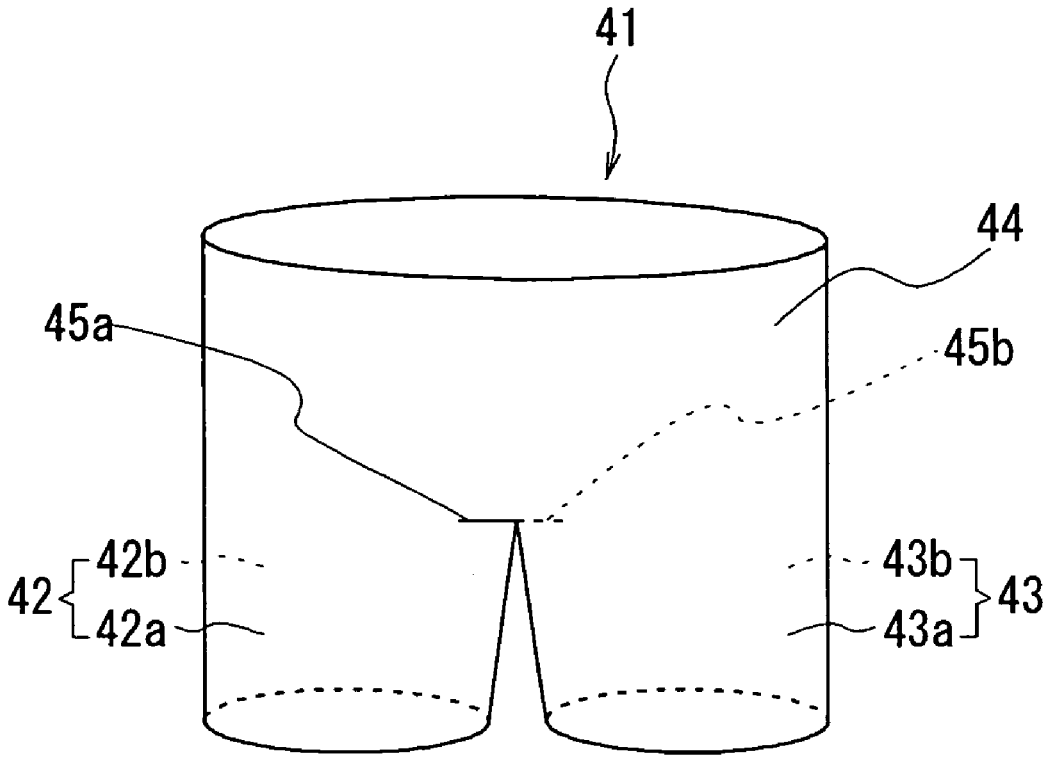
FIG. 11 is a drawing showing the pants formed by the joining of two knitted fabrics according to the second embodiment.

In the following, the knitting of joining together two knitted fabrics is explained with reference to the knitting course diagrams of FIGS. 12-14, taking the knitting of pants 41 shown in FIG. 11 for example. In this illustrated embodiment, the knitting ① and the knitting ② of FIG. 3(*a*) are performed concurrently. The pants 41 comprises a right foot portion 42, a left foot portion 43, and a body portion 44, and gores 45*a*, 45*b* are formed in the joining portion of the right foot portion 42 and the left foot portion 43. In the second embodiment, immediately after the loop formation made on an every two needle basis, formation of the gores start without overlapping loops (Steps 12~15 of the first embodiment), differently from the first embodiment.

The right foot portion 42 and the left foot portion 43 correspond to the second knitted fabric 22 and the first knitted fabric 21 of FIG. 3, respectively. The step 1 of FIG. 12 shows the initial state before formation of the gores in which the right foot portion 42 and the left foot portion 43 are adjacent to each other. The loops surrounded by a chain line 45 are the overall number of loops in the joining region for the gore to be formed.

Figure 12:
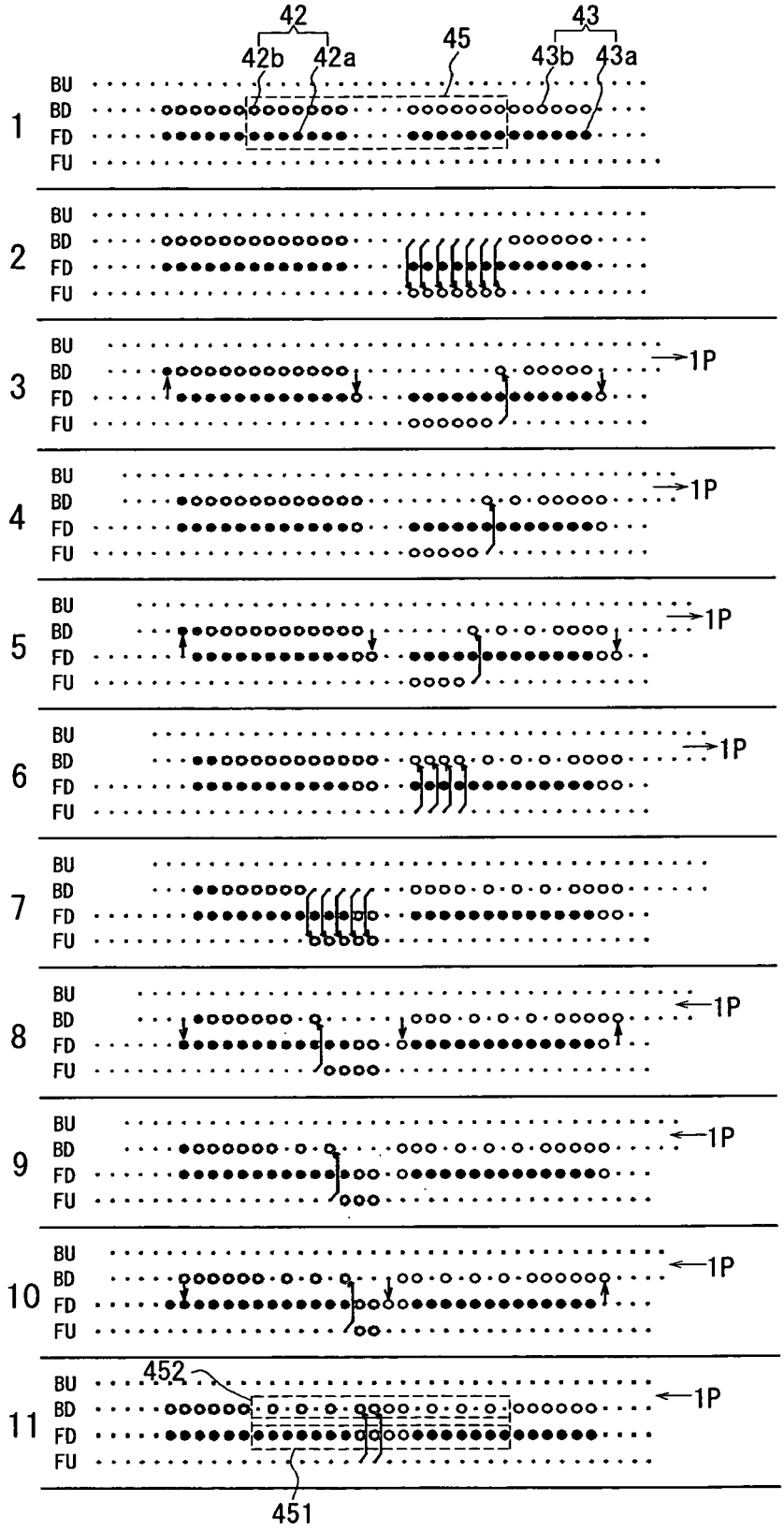
FIG. 12 is a knitting course drawing showing the joining of the two knitted fabrics according to the second embodiment.
Figure 13:
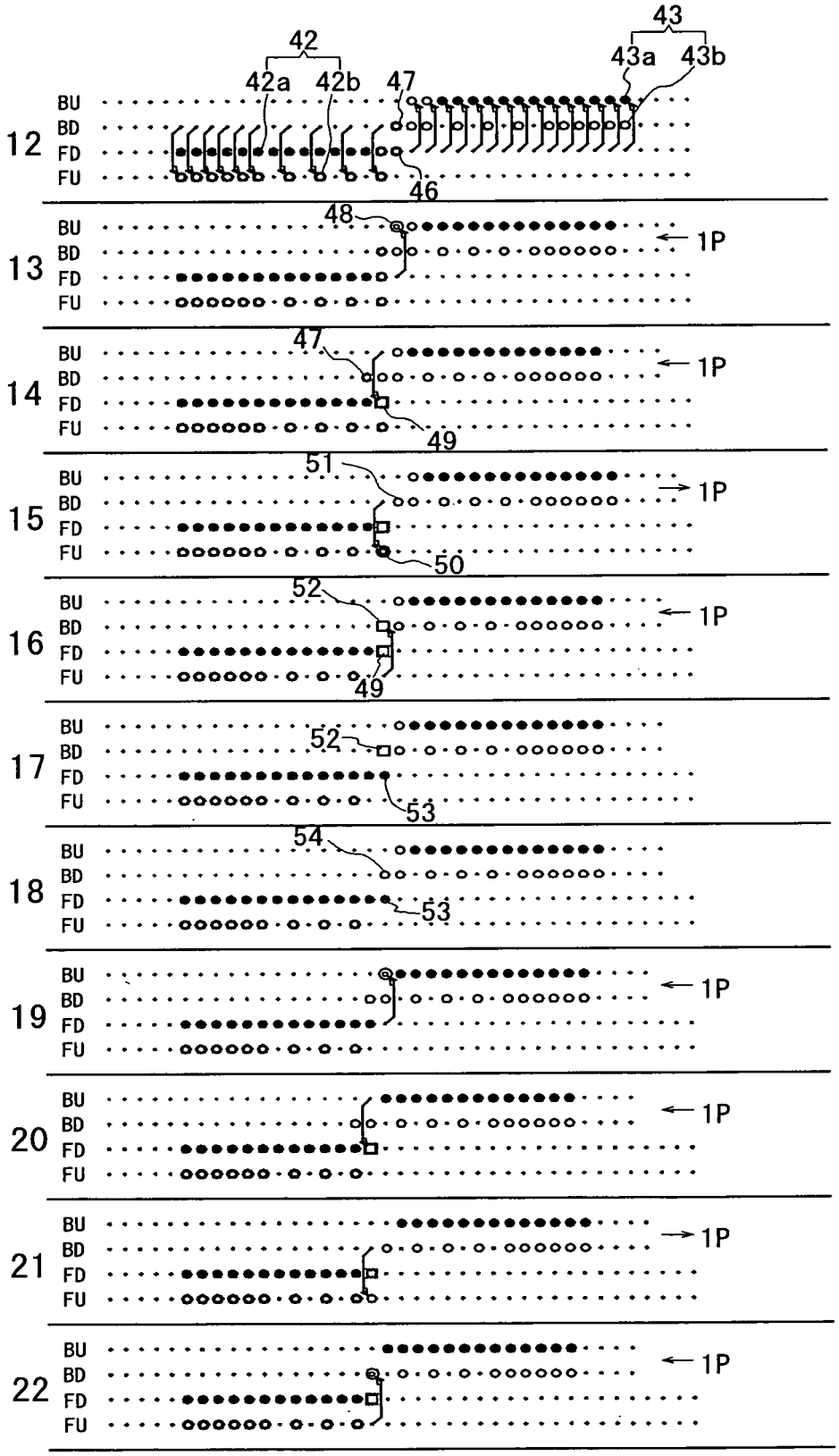
FIG. 13 is a knitting course drawing showing the joining of the two knitted fabrics according to the second embodiment.
Figure 14:
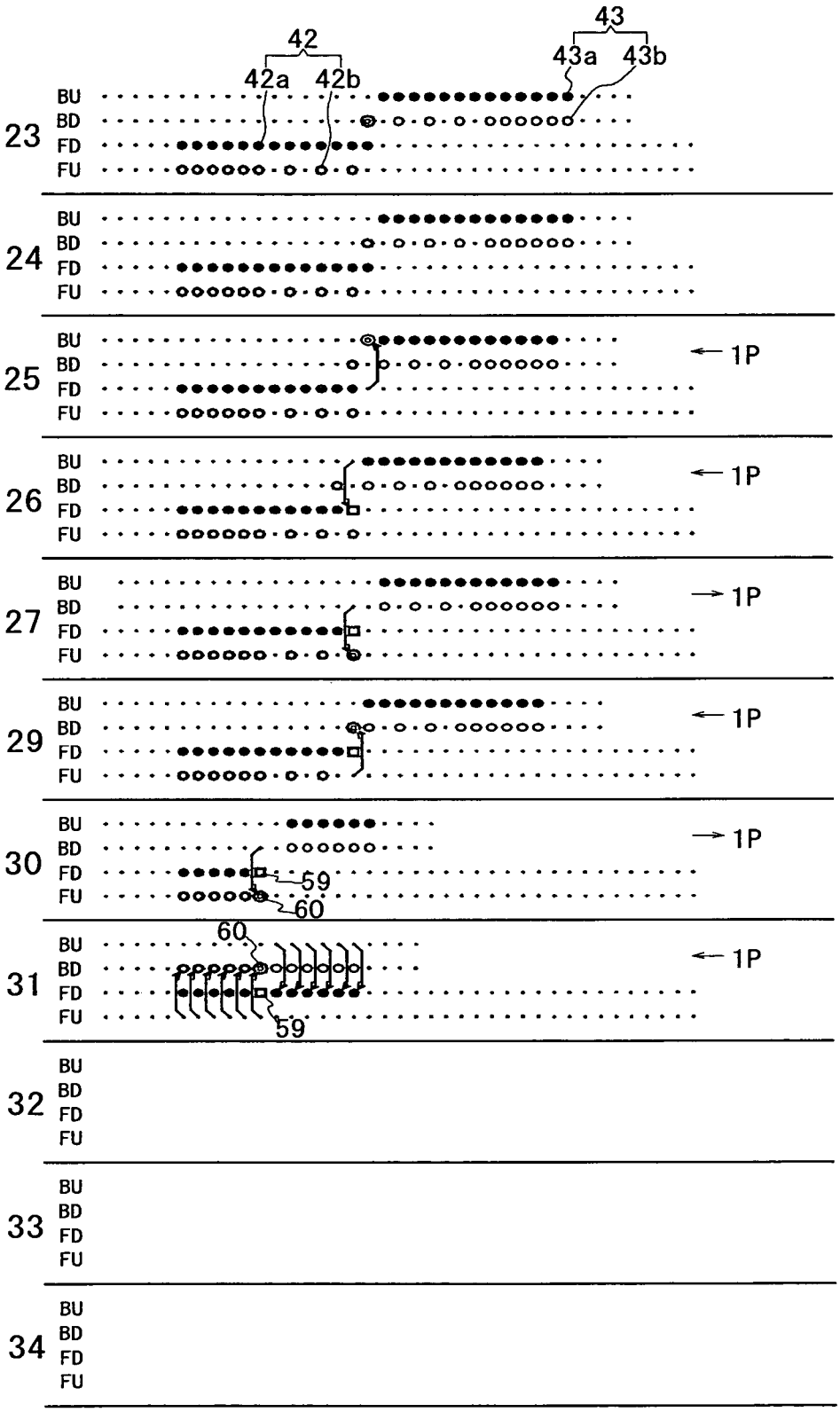
FIG. 14 is a knitting course drawing showing the joining of the two knitted fabrics according to the second embodiment.

The numerals at the left side of FIGS. 12-14 indicate the serial number of knitting steps, and the alphabetical characters FU, FD, BD, and BU indicate a front upper needle bed, a front lower needle bed, a back lower needle bed, and a back upper needle bed, respectively.

As to the gores shown in the step 1, a part of the loops of the back knitted fabric part held on the back needle bed are eventually used for the gore of the front knitted fabric part. The joining region of the back knitted fabric part is less than that of the front knitted fabric part. In order that the joining region of the back knitted fabric part can contain as many needles as the needles used in the joining region of the front knitted fabric part, the loops in the joining region of the back knitted fabric part are shifted in the next step so that the loops in the joining region of the back knitted fabric part can be held on an every two needle basis on the back needle bed.

First, in the step 2, the loops in the joining region of the back knitted fabric part of the left foot portion 43 are transferred to the front upper needle bed FU.

In the step 3, after the back needle bed is racked rightward one pitch, the right foot portion 42 is subjected to rotation of the knitting in such a manner that a loop of its back knitted fabric part located at an end thereof on the left foot portion side is transferred to the front lower needle bed FD, while also a loop of its front knitted fabric part located at an outer end thereof is transferred to the back lower needle bed BD. Further, while the left foot portion 43 is subjected to rotation of the knitting in such a manner that a loop of its back knitted fabric part located at an end thereof on the right-hand side as viewed in FIG. 12 is transferred to the front lower needle bed FD, one of the loops in the joining region on the front upper needle bed FU located at an end thereof far away from the right foot portion is transferred back to the back lower needle bed BD.

In the step 4, after the back needle bed is racked rightward one pitch, one of the loops of the left foot portion 43 in its joining region on the front upper needle bed FU, located at an end thereof far away from the right foot portion 42, is transferred back to the back lower needle bed BD.

When there are many loops in the joining region, the operations of the racking and loop transfer are repeatedly performed in the steps 4 to 5. As a result of the operations of racking and loop transfer in the steps 4 to 5, the loops in the joining region of the back knitted fabric part of the left foot portion 43 are put in the state of being held on an every two needle basis.

Then, in the step 6, after the needle bed is racked one pitch, the remaining loops held on the front upper needle bed FU are transferred back to the back lower needle bed BD.

Then, the joining region of the right foot portion 42 is subjected to the same racking and loop transfer operations as in the steps 2 to 6 (Steps 7 to 11). In this step, the racking direction is opposite to the racking direction in the steps 2 to 6.

In the step 11, the zone surrounded with a dotted frame 451 is the joining region on the front knitted fabric part side, and the zone surrounded with dotted frame 452 is the joining region on the back knitted fabric part side. As shown in the step 11, the number of loops (number of wales) of the joining region of the back knitted fabric part are decreased by four loops below the number of loops (number of wales) of the joining region of the front knitted fabric part.

Although the number of loops of the joining region of the back knitted fabric part are decreased like this, the tubular knitted fabrics can be arranged on the needle beds substantially symmetrically with respect to lengths of their front and back knitted fabric parts. Also, the loops of the right foot portion 42 and the left foot portion 43 located at ends thereof on the outer side are prevented from being shifted to the opposed needle beds, thus being put in the same state as in the step 1.

In this embodiment, the loops of the front and back knitted fabric parts of the right and left foot portions 42, 43 located at the ends thereof can be allowed to remain stayed at the ends thereof on the front and back needle beds. As a result, the loops are prevented from being twisted. Hence, even before the start of the joining, new loops can be formed in the right and left foot portions 42, 43 while avoiding formation of twist in the old loops.

The formation of the gores is started from this state. In the step 12 shown in FIG. 13, the loops of the front knitted fabric part 43*a* of the left foot portion are transferred to the back upper needle bed BU and also the loops of the back knitted fabric part 42*b* of the right foot portion are transferred to the front upper needle bed FU, remaining the loop located at an end thereof on the left foot portion 43 side stayed.

In the step 13, after the back needle bed is racked leftward one pitch, a loop 46 of the front knitted fabric part 42*a* of the right foot portion located at the end thereof on the left foot portion 43 side is overlapped with a loop of the front knitted fabric part 43*a* of the left foot portion located at the end thereof on the right foot portion 42 side held on the back upper needle bed BU, to form a double loop 48.

In the step 14, after the back needle bed is further racked leftward one pitch, the double loop 48 is transferred to the front lower needle bed FD and overlapped with a loop of the right foot portion 42 located at an end thereof on the left foot portion 43 side, to form a triple loop 49.

In the step 15, after the back needle bed is racked rightward one pitch, the loop 47 of the back knitted fabric part 42*b* of the right foot portion located at the end thereof on the left foot portion 43 side held on the back lower needle bed BD is transferred to the front upper needle bed FU, to form a double loop 50.

In the step 16, after the back needle bed is racked leftward one pitch, the double loop 50 is overlapped with a loop 51 of the back knitted fabric part 43*b* of the left foot portion located at the end thereof on the right foot portion 42 side held on the back lower needle bed BD to form a triple loop 52.

In the step 17, a new loop 53 is formed following the triple loop 49 and, then, in the step 18, a new loop 54 is formed following the triple loop 52.

In the steps 19 to 30, the same knitting operations as those in the steps 13-18 are given to target loops. In the step 30, the loop of the front knitted fabric part 42*a* of the right foot portion located at the right end results in a triple loop 59, and the loop held on the back lower needle bed BD is transferred to the front upper needle bed FU, to form a double loop 60.

In the step 31, all the loops of the back knitted fabric part 42*b* of the right foot portion held on the front upper needle bed FU are transferred to the back lower needle bed BD, together with the double loop 60 formed in the step 30. Further, all the loops of the front knitted fabric part 43*a* of the left foot portion held on the back upper needle bed BU are transferred to the front lower needle bed FD. The joining of the right foot portion 42 and the left foot portion 43 for forming the gores 45*a*, 45*b* is completed with this, as shown in the step 31. As to the gores 45*a*, 45*b* formed by the knitting described above, the gore 45*a* is formed on the front side by overlapping the loops of the front knitted fabric part 43*a* of the left foot portion with the loops of the front knitted fabric part 42*a* of the right foot portion, and the gore 45*b* is formed on the back side by overlapping the loops of the back knitted fabric part 42*b* of the right foot portion with the loops of the back knitted fabric part 43*b* of the left foot portion. Although the embodiment wherein the gore of the front knitted fabric part is larger has been illustrated above, the gore of the back knitted fabric part may be made larger than that of the front knitted fabric part.

Third Embodiment

The third embodiment is the embodiment wherein while three tubular knitted fabrics are knitted on an every two needle basis using the four-bed flat knitting machine, the three tubular knitted fabrics are joined together to form the sweater 1 shown in FIG. 1. In the third embodiment, the gores are formed after the loops in the joining region of the larger gore are put in the state of being held on an every needle basis.

Figure 15:
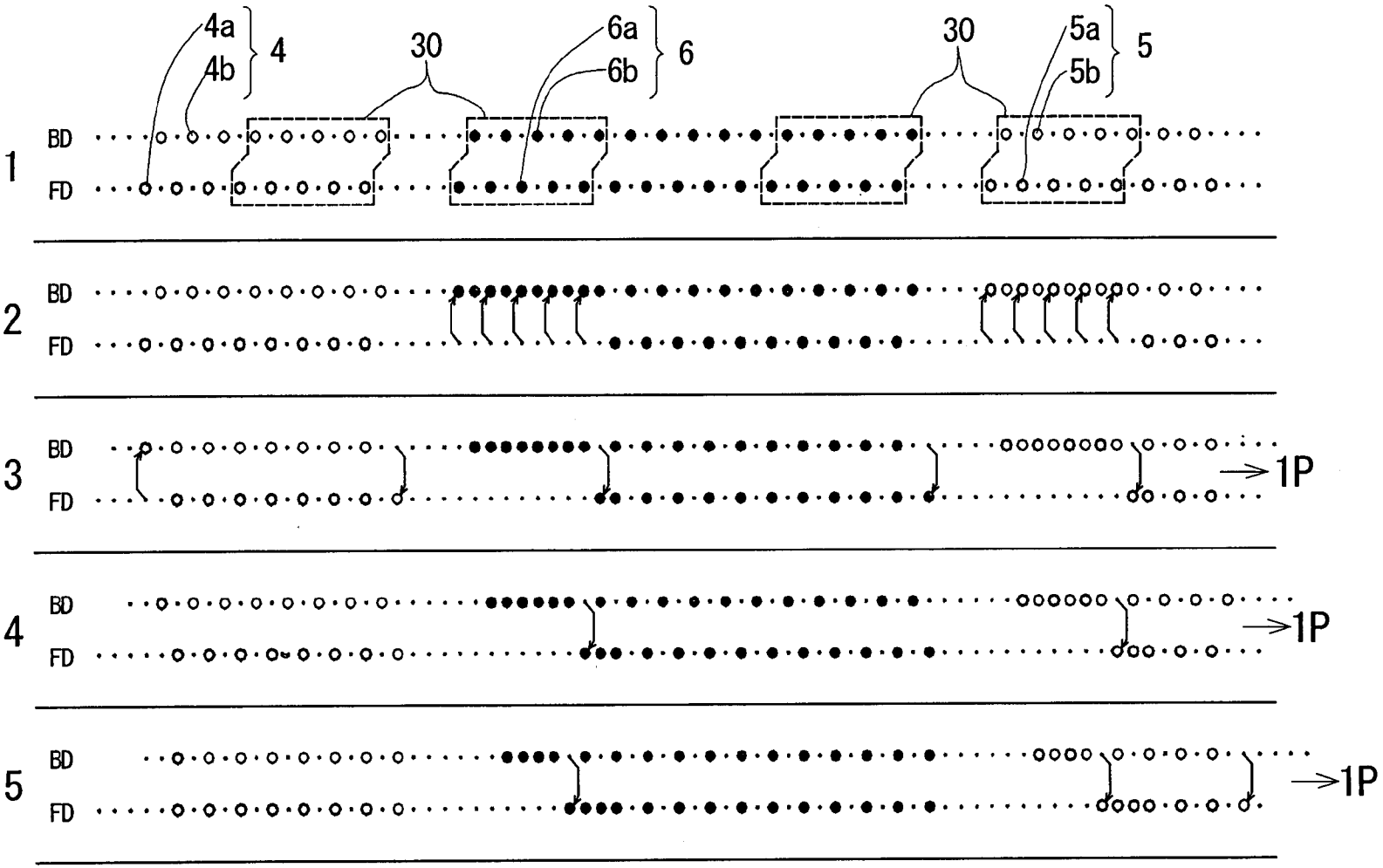
FIG. 15 is a knitting course drawing showing the joining of three knitted fabrics according to a third embodiment.
Figure 16:
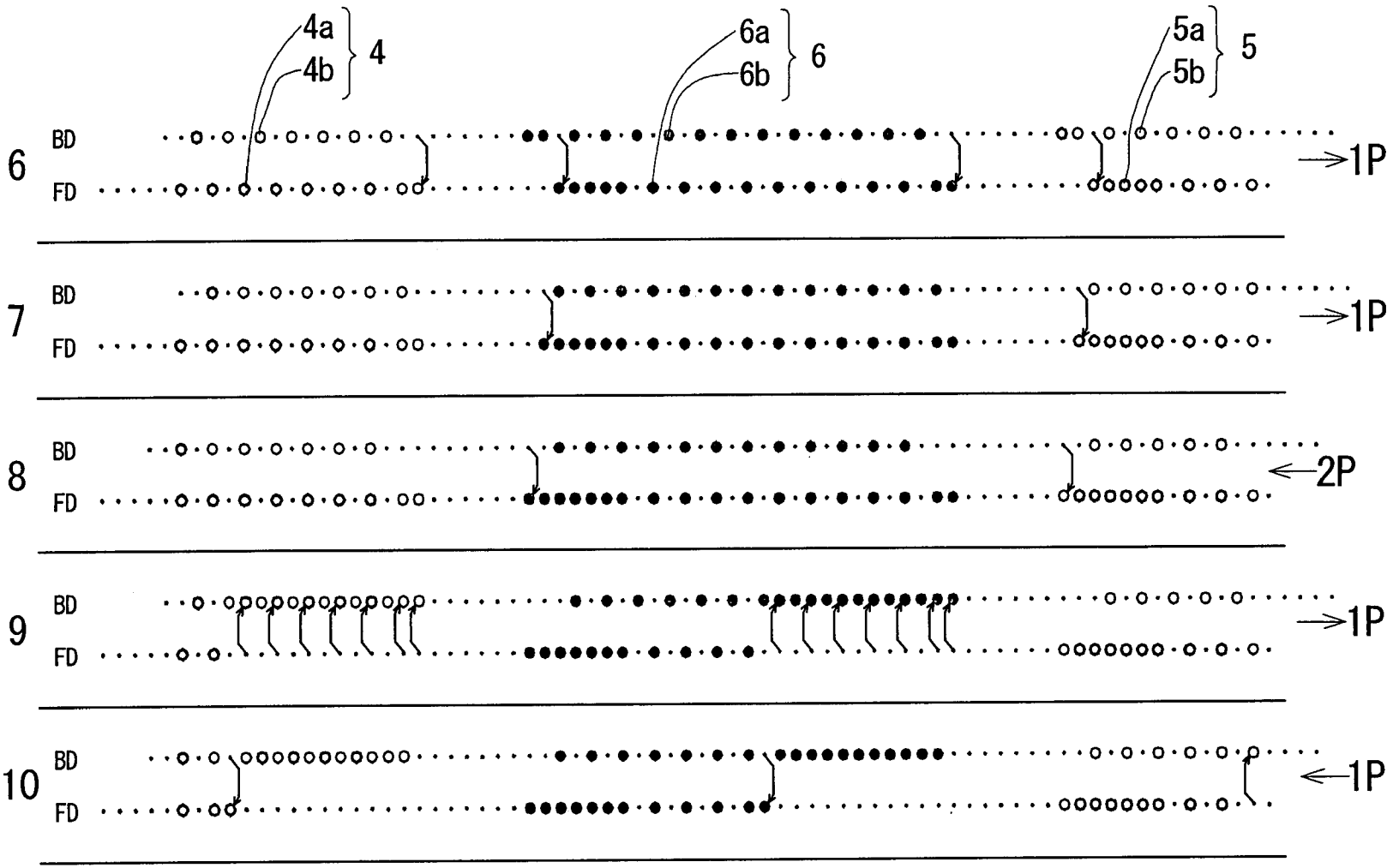
FIG. 16 is a knitting course drawing showing the joining of the three knitted fabrics according to the third embodiment.
Figure 17:
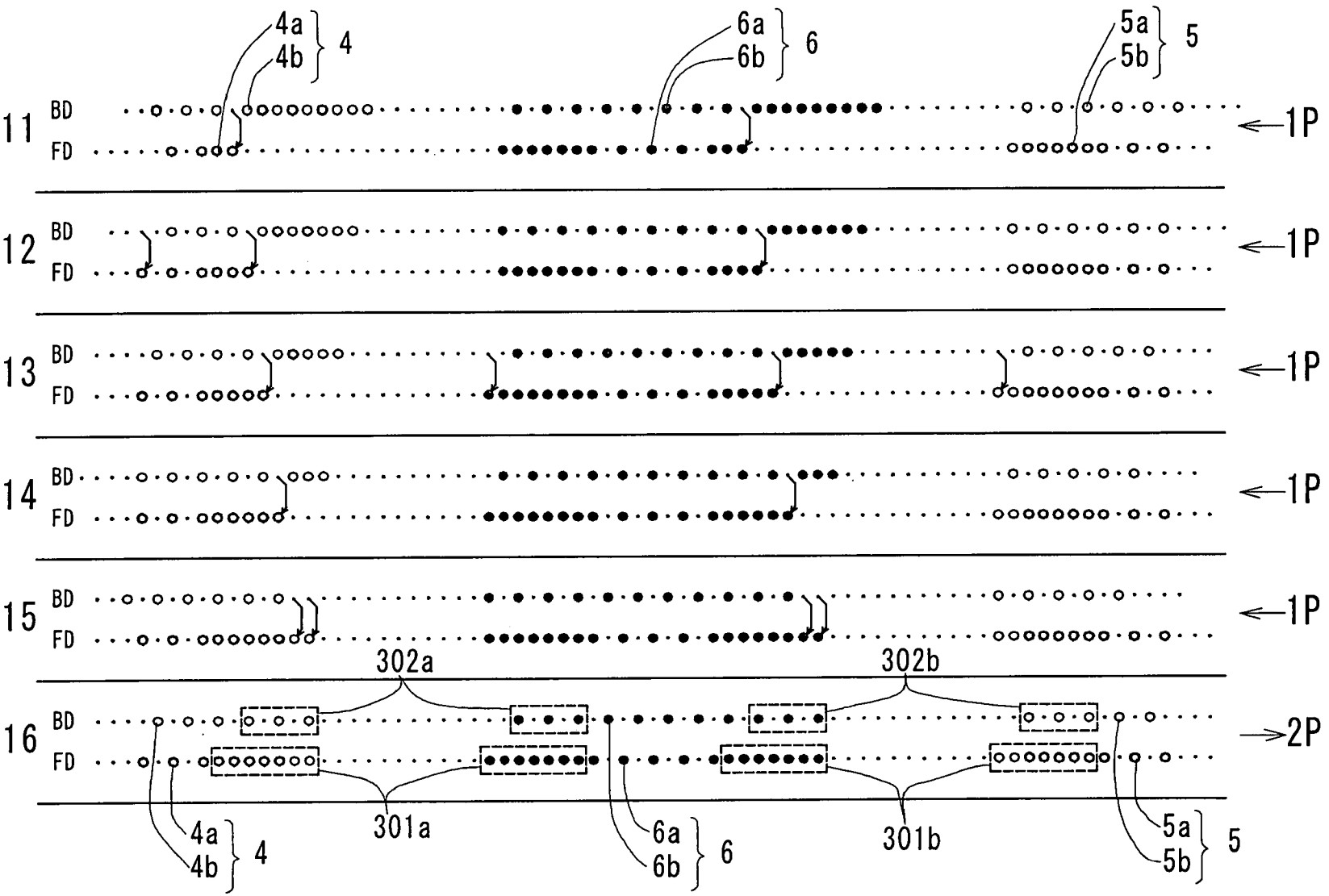
FIG. 17 is a knitting course drawing showing the joining of the three knitted fabrics according to the third embodiment.
Figure 18:
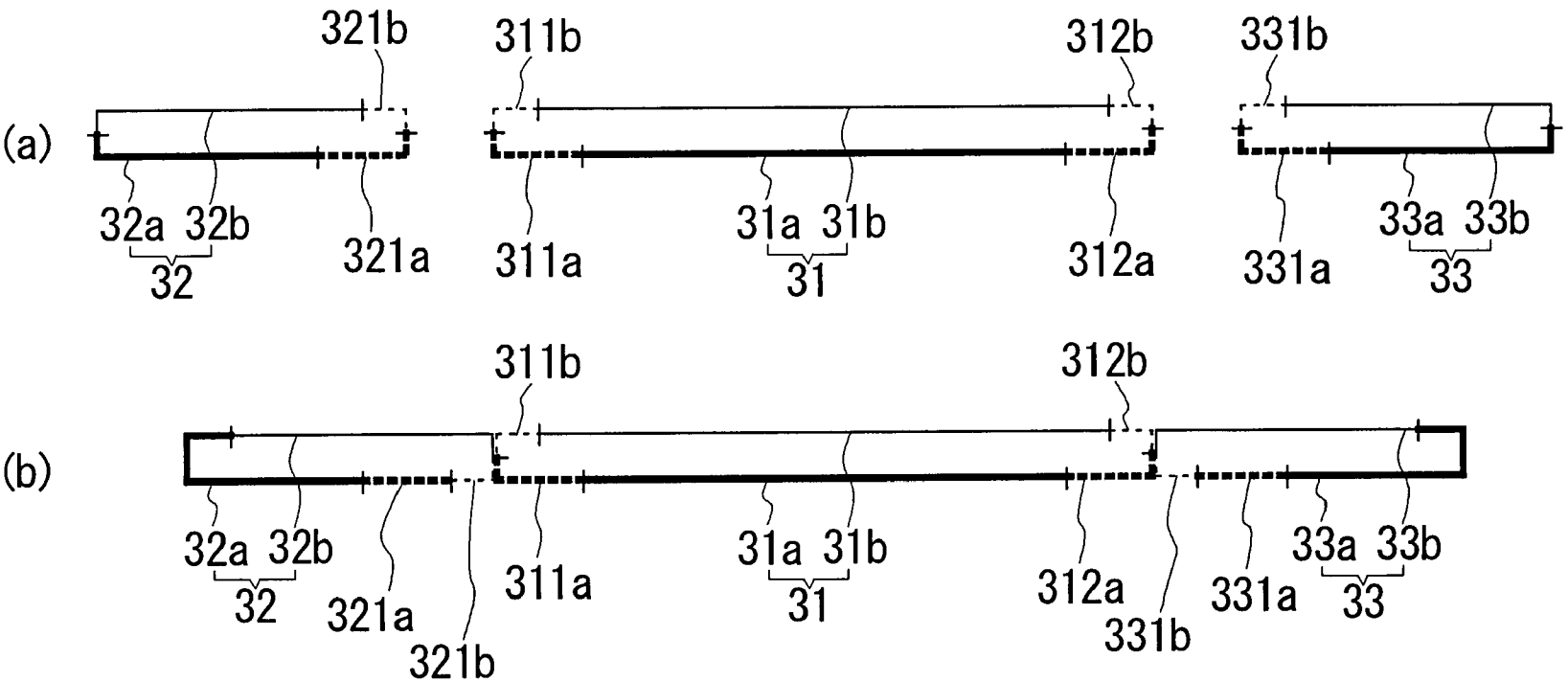
FIG. 18 is a part of the knitting course drawing showing the conventional of tubular knitted fabrics (sweater) showing the completed state of the joining.

The knitting course drawings shown in FIGS. 15 to 17 show the knitting steps taken after the state of the three tubular knitted fabrics being knitted up to the sides until the start of the joining. The sweater of the third embodiment is also knitted so that the gore of the front knitted fabric part can be larger in size (volume) than that of the back knitted fabric part.

The numerals at the left side of FIGS. 15-17 indicate the serial number of knitting steps. The sweater of this embodiment is knitted using the four-bed flat knitting machine, though the front upper needle bed and the back upper needle bed are omitted from the knitting course drawings. In the drawings, the front lower needle bed is designated by FD and the back lower needle bed is designated by BD.

The step 1 shown in FIG. 15 shows the initial state before the joining of the sleeves 4, 5 and the body 6 starts. The respective tubular knitted fabrics are knitted on the front and back needle beds on an every two needle basis. In the step 1, the loops surrounded by chain lines 30 are the loops in the joining region for the gores to be formed.

In this embodiment, a part of the loops in the joining regions of the back knitted fabric parts held on the back needle bed are eventually used for the gores of the front knitted fabric parts. The joining region of the back knitted fabric part is less in number of needles. Accordingly, the loops in the joining region of the large gore are shifted in such a manner that the loops in the joining region of the large gore can be held on an every needle basis.

First, in the step 2, the loops in the joining region of the front knitted fabric part 6*a* of the body 6 located on the right sleeve side are transferred to empty needles of the back lower needle bed BD and also the loops in the joining region of the front knitted fabric part 5*a* of the left sleeve 5 are transferred to empty needles of the back lower needle bed BD.

In the step 3, after the back needle bed is racked rightward one pitch, the right sleeve 4 is subjected to rotation of the knitting in such a manner that a loop of its back knitted fabric part located at an end thereof on the body side is transferred to the front lower needle bed FD at a position next to a loop of its front knitted fabric part located at an end thereof, while also a loop of its front knitted fabric part located at an outer end thereof is transferred to the back lower needle bed BD at a position adjacent to a loop of its back knitted fabric part located at a lateral end thereof.

Further, one of the loops of the body 6 and one of the loops of the left sleeve 5 in their joining regions on the back lower needle bed BD, located at an end thereof far away from the right sleeve 4, are transferred back to the front lower needle bed FD. The body 6 is subjected to rotation of the knitting in such a manner that one of the loops of the body 6 located at an end thereof on the left sleeve side are transferred to positions adjacent to loops of their front knitted fabric parts on the front lower needle bed FD located at lateral ends thereof.

In the step 4, after the back needle bed is racked rightward one pitch, one of the loops of the body 6 and one of the loops of the left sleeve 5 in their joining regions on the back lower needle bed BD, located at an end thereof far away from the right sleeve 4, are transferred back to the front lower needle bed FD.

In the step 5, after the back needle bed is racked rightward one pitch, one of the loops of the body 6 and one of the loops of the left sleeve 5 in their joining regions on the back lower needle bed BD, located at an end thereof far away from the right sleeve 4, are transferred back to the front lower needle bed FD. The left sleeve 5 is subjected to rotation of the knitting in such a manner that one of the loops of the back knitted fabric part of the left sleeve 5, which are located at an end portion thereof far away from the body, are transferred to positions adjacent to loops of its front knitted fabric parts on the front lower needle bed FD located at lateral ends thereof.

In the step 6, after the back needle bed is racked rightward one pitch, one of the loops of the body 6 and one of the loops of the left sleeve 5 in their joining regions on the back lower needle bed BD, which are located at ends thereof far away from the right sleeve 4 are transferred back to the front lower needle bed FD. The right sleeve 4 is subjected to rotation of the knitting in such a manner that one of the loops of the back knitted fabric part of the right sleeve 4, which are located at an end portion thereof on the body side, are transferred to positions adjacent to loops of its front knitted fabric parts on the front lower needle bed FD located at lateral ends thereof.

In the step 7, the same operations as those in the step 4 are performed. If the front and back knitted fabric parts are larger in joining region than those of the illustrated embodiment, then the operations of the steps 3 to 7 will be repeatedly performed until all the loops in the joining regions 30 on the front knitted fabric part side shown in the step 1 are gone in the joining regions. Then, in the step 8, after the back needle bed is racked leftward two pitches, one of the loops of the body 6 and one of the loops of the left sleeve 5, which are located at ends thereof on the right sleeve side and held on the back lower needle bed BD, are transferred to the front lower needle bed FD.

In the step 9, after the back needle bed is racked rightward one pitch, the loops in the joining region of the front knitted fabric part 6*a* of the body 6 on the left sleeve side are transferred to empty needles of the back lower needle bed BD and also the loops in the joining region of the front knitted fabric part 4*a* of the right sleeve 4 are transferred to empty needles of the back lower needle bed BD.

Then, the joining region of the body 6 located on the left sleeve side and the joining region of the right sleeve 4 are subjected to the same racking and loop transfer operation as in the steps 2 to 7 (Steps 10 to 14). In this step, the racking direction is opposite to the racking direction in the steps 2 to 7.

In the step 15, after the back needle bed is racked leftward one pitch, two loops of each of the body 6 and the right sleeve 4, which are located at end portions thereof on the right sleeve side and held on the back lower needle bed BD, are transferred to the front lower needle bed FD.

In the step 16, the loops in the joining region of the front knitted fabric part 6*a* of the body 6 of the large gore and the loops in the joining regions 301*a*, 301*b* of the front knitted fabric parts 4*a*, 5*a* of the right and left sleeves 4, 5 of the large gore are put in the state of being held on an every needle basis, not on an every two needle basis. On the other hand, the loops in the joining regions 302*a*, 302*b* of the small gore are still in the state of being held on an every two needle basis. Preferably, the knitting of one new course is performed from the state of the step 16.

As seen from the foregoing, when the tubular knitted fabrics are knitted on an every two needle basis, the number of loops in the joining regions of the back knitted fabric parts are decreased, but the tubular knitted fabrics can be arranged on the needle beds substantially symmetrically with respect to lengths of their front and back knitted fabric parts. Also, the loops of the right sleeve 4 and the left sleeve 5 located at the ends on the side thereof opposite to the body are prevented from being shifted to the opposed needle beds, thus being put in the same state as in the step 1.

In this embodiment as well, the loops of the respective sleeves located at the ends on the side thereof opposite to the body can be put in the same state as in the step 1, remaining stayed at the ends of their front and back knitted fabric parts. Thus, the loops are prevented from being put in the state of being shifted to the opposed needle beds, preventing formation of twist in the loops, different from the prior art. Hence, even before the start of the joining, new loops can be formed in the sleeves while avoiding formation of twist in the old loops.

Thus, when one new course is knitted from the state of the step 16, the loop transfer can be achieved by the new loops thus formed, thus facilitating the knitting.

Then, the formation of the gores is started from this state, as is the case with the first embodiment. In this embodiment as well, in order to form the gores, the knitting of the knitted fabric of the body 6 being subjected to the bind-off process from one lateral end thereof to the other lateral end thereof, the knitting of the loops in the joining region of the body 6 located on the right side side and the loops in the joining region of the knitted fabric of the right sleeve 4 being overlapped with each other from the lateral ends thereof so that their front knitted fabric parts can be overlapped with each other and their back knitted fabric parts can be overlapped with each other, and the knitting of the loops in the joining region of the body 6 located on the left side side and the loops in the joining region of the knitted fabric of the left sleeve 5 being overlapped with each other from the lateral ends thereof so that their front knitted fabric parts can be overlapped with each other and their back knitted fabric parts can be overlapped with each other are performed concurrently.

Further, in the third embodiment as well, the knitting of the loops in the joining regions being overlapped with each other and the knitting of those loops being subjected to the bind-off process are performed concurrently, while on the other hand, the joining of the joining regions of their front knitted fabric parts and the joining of the joining regions of their back knitted fabric parts are performed separately. In other words, in this embodiment, the knitting ① and ② of FIG. 3(*b*) are performed concurrently, first, and, then, the knitting ③ and ④ of FIG. 3(*c*) are performed concurrently.

It is to be noted that this joining method wherein the tubular knitted fabrics are knitted on an every two needle basis and also the joining regions of the large gore are put in the state of being held on an every needle basis, like the joining method of the third embodiment, is, of course, applicable to the knitting of another types of tubular knitted fabrics like pants and tights of the second embodiment.

The invention claimed is:

1. A knitted fabric joining method using a flat knitting machine comprising at least a pair of front and back needle beds, which extend in a longitudinal direction and are located in opposed positions in a cross direction and at least either of which is capable of being racked in the longitudinal direction, wherein at least two tubular knitted fabrics, each comprising a front knitted fabric part and a back knitted fabric part, are knitted in succession in a direction of course and overlapped with each other at their joining region at which gores of different sizes between the front knitted fabric part and the back knitted fabric part are formed, thereby being joined together, said method comprising steps of:

holding in joining regions of the front and back knitted fabric parts, which are held on the opposed needle beds, loops in the joining region of a small gore and loops in the joining region of a large gore in a manner that the loops of both ends of the joining region of a first one of the small or large gore are held substantially opposite to the loops of both ends of the joining region of a second one of the small or large gore, wherein both joining regions contain needles in equal number, with at least an empty needle being contained in at least one of the joining regions;

forming a gore at joining portions of the tubular fabrics by joining together loops of one tubular knitted fabric which are situated in the joining region and located at a lateral end thereof and loops of another tubular knitted fabric which are situated in the joining region and located at a lateral end thereof starting from a loop located adjacent to a boundary between the front knitted fabric part and the back knitted fabric part, such that the loops being joined are overlapped with each other in such a manner that the loops located at a same position with respect to the boundary are overlapped with each other and then are subjected to a bind-off process; and knitting a single tubular knitted fabric.

2. The knitted fabric joining method according to claim 1, wherein said method being used to join a first knitted fabric and a second knitted fabric, said method further comprising the following steps to be performed before the start of the joining of the first and second knitted fabrics:

(1) transferring the loops in the joining region of the front knitted fabric part or the back knitted fabric part of the first knitted fabric to an opposed needle bed;

(2) racking the front needle bed or the back needle bed rightward or leftward, and then rotating the second knitted fabric, and transferring back the loops of the joining region of the first knitted fabric as transferred in step (1) to the opposed needle bed sequentially starting from the loop located at the end of the joining region of the first knitted fabric far from the second knitted fabric, while transferring the rest of the loops of the front or back knitted fabric part having the loops transferred in step (1) to the opposed needle bed starting from a loop located at the end of the first knitted fabric far from the second knitted fabric so that, in the first knitted fabric,the loops of both ends of the joining region of a first gore of the front or back knitted fabric part are held substantially opposite to the loops of both ends of the joining region of a second gore of the other knitted fabric part, wherein both joining regions contain needles in equal number, with at least an empty needle being contained in at least one of the joining regions, (3) transferring the loops in the joining region of the front knitted fabric part or the back knitted fabric part of the second knitted fabric, which corresponds in size to the joining region in which the loops were transferred in step (1), to an opposed needle bed, and (4) racking the front needle bed or the back needle bed in a direction opposite to the direction of the needle bed being racked in step (2), and then rotating the first knitted fabric, and transferring back the loops in the joining region of the second knitted fabric as transferred in step (3) to the opposed needle bed sequentially starting from the loop located at the end of the joining region of the second knitted fabric far from the first knitted fabric, while transferring the rest of the loops of the front or back knitted fabric part having the loops transferred in step (3) to the opposed needle bed starting from a loop located at the end of the second knitted fabric far from the first knitted fabric so that, in the second knitted fabric, the loops of both ends of the joining region of a first gore of the front or back knitted fabric part are held substantially opposite to the loops of both ends of the joining region of a second gore of the other knitted fabric part, wherein both joining regions contain needles in equal number, with at least an empty needle being contained in at least one of the joining regions.

3. The knitted fabric joining method according to claim 1, wherein said method is used to join a second knitted fabric and a third knitted fabric to a first knitted fabric after knitting the first, second and third knitted fabrics wherein the first knitted fabric is sandwiched between the second and third knitted fabrics, said method further comprising the following steps to be performed before the start of joining of the first, second, and third knitted fabrics:

(1) transferring the loops in the joining region of the front knitted fabric part or the back knitted fabric part of the first knitted fabric to be joined to the second knitted fabric to an opposed needle bed, while transferring the loops in the joining region of the third knitted fabric having a gore, which corresponds in size to the joining region of the first knitted fabric in which the loops were transferred, to the opposed needle bed, (2) racking the front needle bed or the back needle bed rightward or leftward, and then rotating the second knitted fabric, and transferring beck the loops in the joining region of the first and third knitted fabrics as transferred in step (1)to the opposed needle bed sequentially starting from the loop located at the end of the joining region of the first and third knitted fabrics far from the second knitted fabric, while transferring the rest of the loops of the front or back knitted fabric part having the loops transferred in step (1) to the opposed needle bed starting from a loop located at the end of the first and third knitted fabrics respectively far from the second knitted fabric so that, in the first and third knitted fabrics, the loops of both ends of the joining region of a first gore of the front or back knitted fabric part are held substantially opposite to the loops of both ends of the joining region of a second gore of the other knitted fabric part wherein both the joining regions contain needles in equal number, with at least an empty needle being contained in at least one of the joining regions, (3) transferring the loops in the joining region of the first knitted fabric to be joined to the third knitted fabric, which corresponds in size to the joining region in which the loops were transferred in step (1), to an opposed needle bed, while transferring the loops in the joining region of the second knitted fabric, which corresponds in size to the joining region of the first knitted fabric in which the loops were transferred in step (1), to the opposed needle bed, and (4) racking the front needle bed or the back needle bed in a direction opposite to the direction of the needle bed being racked in step (2), and then rotating the third knitted fabric, and transferring back the loops in the joining region of the first and second knitted fabrics as transferred in step (3) to the opposed needle bed sequentially starting from the loop located at the end of the joining region of the first and second knitted fabrics far from the third knitted fabric, while transferring the rest of the loops of the front or back knitted fabric part of the first and second knitted fabrics having the loops transferred in step (3) to the opposed needle bed starting from a loop located at the end of the first and second knitted fabrics respectively far from the third knitted fabric so that, in the first and second knitted fabrics, the loops of both ends of the joining region of a first gore of the front or back knitted fabric part are held substantially opposite to the loops of both ends of the joining region of a second gore of the other knitted fabric part, wherein both joining regions contain needles in equal number, with at least an empty needle being contained in at least one of the joining regions.

* * * * *